US012220607B2

(12) United States Patent
Lagree et al.

(10) Patent No.: US 12,220,607 B2
(45) **Date of Patent: *Feb. 11, 2025**

(54) REVERSIBLE RESISTANCE EXERCISE MACHINE

(71) Applicant: Lagree Technologies, Inc., Chatsworth, CA (US)

(72) Inventors: Sebastien Anthony Louis Lagree, Chatsworth, CA (US); Andy H. Gibbs, Oro Valley, AZ (US); Todd G. Remund, Yuba City, CA (US); Samuel D. Cox, Yuba City, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/589,865

(22) Filed: Feb. 28, 2024

(65) Prior Publication Data

US 2024/0198161 A1 Jun. 20, 2024

Related U.S. Application Data

(63) Continuation of application No. 18/306,468, filed on Apr. 25, 2023, now Pat. No. 11,918,839, which is a (Continued)

(51) Int. Cl.
*A63B 21/04* (2006.01)
*A63B 21/00* (2006.01)
(Continued)

(52) U.S. Cl.
CPC ..... *A63B 21/04* (2013.01); *A63B 21/00065* (2013.01); *A63B 21/0442* (2013.01);
(Continued)

(58) Field of Classification Search
CPC . A63B 21/04; A63B 21/0552; A63B 21/4033; A63B 21/00065; A63B 21/0442;
(Continued)

(56) References Cited

U.S. PATENT DOCUMENTS 131,886 A 10/1872 Little
1,621,477 A 3/1927 Pilates
(Continued)

FOREIGN PATENT DOCUMENTS

WO 2004096376 A1 11/2004

*Primary Examiner* — Andrew S Lo
(74) *Attorney, Agent, or Firm* — Neustel Law Offices

(57) ABSTRACT

A reversible resistance exercise machine for reversing the direction of applied resistance against a movable platform of an exercising machine. The exercise machine has a frame, a carriage movably positioned upon the frame, and a plurality of biasing members. A plurality of first tension connectors are accessible near the first end of the carriage and are adapted for removably attaching selected biasing members near the first end of the carriage to resist motion of the carriage in the first direction. A plurality of second tension connectors are accessible near the second end of the carriage and are adapted for removably attaching selected biasing members near the second end of the carriage to resist motion of the carriage in the second direction. A user selectable amount of force may be applied to the carriage to resist movement in either of the first direction and the second direction.

20 Claims, 17 Drawing Sheets

Related U.S. Application Data continuation of application No. 17/503,573, filed on Oct. 18, 2021, now Pat. No. 11,673,014, which is a continuation of application No. 16/797,958, filed on Feb. 21, 2020, now Pat. No. 11,147,999, which is a continuation of application No. 15/657,415, filed on Jul. 24, 2017, now Pat. No. 10,569,118.

(60) Provisional application No. 62/365,519, filed on Jul. 22, 2016.

(51) Int. Cl.

| | |
|---|---|
| ***A63B 21/02*** | (2006.01) |
| ***A63B 21/055*** | (2006.01) |
| ***A63B 21/062*** | (2006.01) |
| ***A63B 21/068*** | (2006.01) |
| ***A63B 21/072*** | (2006.01) |
| ***A63B 22/00*** | (2006.01) |
| ***A63B 22/20*** | (2006.01) |
| ***A63B 71/06*** | (2006.01) |

(52) U.S. Cl.

CPC ..... *A63B 21/0552* (2013.01); *A63B 21/157* (2013.01); *A63B 21/4033* (2015.10); *A63B 21/4045* (2015.10); *A63B 22/0087* (2013.01); *A63B 21/02* (2013.01); *A63B 21/023* (2013.01); *A63B 21/055* (2013.01); *A63B 21/0622* (2015.10); *A63B 21/0628* (2015.10); *A63B 21/068* (2013.01); *A63B 21/072* (2013.01); *A63B 21/154* (2013.01); *A63B 21/4034* (2015.10); *A63B 21/4035* (2015.10); *A63B 22/0007* (2013.01); *A63B 22/001* (2013.01); *A63B 22/201* (2013.01); *A63B 22/203* (2013.01); *A63B 2071/0694* (2013.01)

(58) Field of Classification Search

CPC ..... A63B 21/4045; A63B 22/0087; A63B 21/157; A63B 22/001; A63B 2071/0694; A63B 21/4035; A63B 21/068; A63B 21/0622; A63B 21/023; A63B 21/154; A63B 21/072; A63B 21/0628; A63B 22/203; A63B 22/0007; A63B 22/201; A63B 21/4034; A63B 21/055; A63B 21/02

See application file for complete search history.

(56) References Cited

U.S. PATENT DOCUMENTS

| | | | |
|---|---|---|---|
| 3,770,267 | A | 11/1973 | McCarthy |
| 3,806,094 | A | 4/1974 | Harken |
| 4,759,540 | A | 7/1988 | Yu |
| 4,798,378 | A | 1/1989 | Jones |
| 5,066,005 | A | 11/1991 | Luecke |
| 5,263,913 | A | 11/1993 | Boren |
| 5,295,935 | A | 5/1994 | Wang |
| D362,700 | S | 9/1995 | Breibart |
| D382,319 | S | 8/1997 | Gerschefske |
| 5,681,249 | A | 10/1997 | Endelman |
| 5,885,197 | A | 3/1999 | Barton |
| 5,967,955 | A | 10/1999 | Westfall |
| 6,045,491 | A | 4/2000 | McNergney |
| 6,179,753 | B1 | 1/2001 | Barker |
| 7,163,500 | B2 | 1/2007 | Endelman |
| 7,803,095 | B1 | 9/2010 | Lagree |
| 7,931,570 | B2 | 4/2011 | Hoffman |
| 8,249,714 | B1 | 8/2012 | Hartman |
| 8,500,611 | B2 | 8/2013 | Hoffman |
| 8,585,554 | B2 | 11/2013 | Shavit |
| 8,641,585 | B2 | 2/2014 | Lagree |
| 9,533,184 | B1 | 1/2017 | Lagree |
| 10,155,129 | B2 | 2/2018 | Lagree |
| 10,046,193 | B1 | 8/2018 | Aronson |
| 2001/0056011 | A1 | 12/2001 | Endelman |
| 2003/0119635 | A1 | 6/2003 | Arbuckle |
| 2004/0043873 | A1 | 3/2004 | Wilkinson |
| 2005/0130810 | A1 | 6/2005 | Sands |
| 2005/0164856 | A1 | 7/2005 | Parmater |
| 2006/0046914 | A1 | 3/2006 | Endelman |
| 2006/0199712 | A1 | 9/2006 | Barnard |
| 2007/0087921 | A1 | 4/2007 | Graham |
| 2008/0070765 | A1 | 3/2008 | Brown |
| 2008/0248935 | A1 | 10/2008 | Solow |
| 2010/0016131 | A1 | 1/2010 | Hoffman |
| 2010/0227748 | A1 | 9/2010 | Campanaro |
| 2011/0143898 | A1 | 6/2011 | Trees |
| 2011/0166002 | A1 | 7/2011 | Savsek |
| 2011/0172069 | A1 | 7/2011 | Gerschefske |
| 2012/0295771 | A1 | 11/2012 | Lagree |
| 2013/0196835 | A1 | 8/2013 | Solow |
| 2014/0011645 | A1 | 1/2014 | Johnson |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2015/0024914 | A1 | 1/2015 | Lagree |
| 2015/0057127 | A1 | 2/2015 | Lagree |
| 2015/0065318 | A1 | 3/2015 | Lagree |
| 2015/0072841 | A1 | 3/2015 | Lagree |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0008657 | A1 | 1/2016 | Lagree |
| 2016/0059060 | A1 | 3/2016 | Lagree |
| 2016/0059061 | A1 | 3/2016 | Lagree |
| 2016/0096059 | A1 | 4/2016 | Lagree |
| 2016/0166870 | A1 | 6/2016 | Lagree |
| 2016/0193496 | A1 | 7/2016 | Lagree |
| 2016/0256733 | A1 | 9/2016 | Lagree |
| 2016/0271452 | A1 | 9/2016 | Lagree |
| 2016/0317858 | A1 | 11/2016 | Lagree |
| 2016/0346593 | A1 | 12/2016 | Lagree |
| 2016/0361602 | A1 | 12/2016 | Lagree |
| 2017/0014664 | A1 | 1/2017 | Lagree |
| 2017/0014672 | A1 | 1/2017 | Lagree |
| 2017/0036057 | A1 | 2/2017 | Lagree |
| 2017/0036061 | A1 | 2/2017 | Lagree |
| 2017/0043210 | A9 | 2/2017 | Lagree |
| 2017/0065846 | A1 | 3/2017 | Lagree |
| 2017/0072252 | A1 | 3/2017 | Lagree |
| 2017/0087397 | A1 | 3/2017 | Lagree |
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |

REVERSIBLE RESISTANCE EXERCISE MACHINE

CROSS REFERENCE TO RELATED APPLICATIONS

The present application is a continuation of U.S. application Ser. No. 18/306,468 filed on Apr. 25, 2023, which is a continuation of U.S. application Ser. No. 17/503,573 filed on Oct. 18, 2021 now issued as U.S. Pat. No. 11,673,014, which is a continuation of U.S. application Ser. No. 16/797,958 filed on Feb. 21, 2020 now issued as U.S. Pat. No. 11,147,999, which is a continuation of U.S. application Ser. No. 15/657,415 filed on Jul. 24, 2017 now issued as U.S. Pat. No. 10,569,118, which claims priority to U.S. Provisional Application No. 62/365,519 filed Jul. 22, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a reversible resistance exercise machine for reversing the direction of applied resistance against a movable platform of an exercising machine.

Related Art

Any discussion of the related art throughout the specification should in no way be considered as an admission that such related art is widely known or forms part of common general knowledge in the field.

The body of works related to resistance-based exercise machines is voluminous and are well known to those skilled in the art. Such resistance exercise machines include, but are not limited to devices that provide for a variable stack of weights connected to a cable or mechanical linkage which is moved by an exerciser during an exercise, or a movable exercise platform that may be connected to one or more spring biasing members, the biasing members thereby providing for resistance against the exerciser will work as a means to move the movable platform. Many types of machines representative of the exercise machines just described include traditional Pilates apparatuses, universal gyms, lat pull down machines, leg press machines, chest press machines, to name just a few.

One universally accepted function of resistance training machines is that the resistance is typically provided for in only one direction, and the exercises are performed against that resistance in the opposite direction. Typical resistance training machines do not provide for the direction of resistance to be easily reversed to the opposite direction.

Trainers have long understood the advantages of exercising opposing muscles during a workout, and have long understood that specific exercise machines are designed to provide resistance for training certain muscles, and that exercisers who desire exercising opposing muscles must typically move from one exercise machine after exercising one muscle group, to a second exercise machine to exercise the opposing muscle group.

Those skilled in the art will appreciate the advantages of an exercise machine that provides for the reversing of the direction of resistance so that exercisers may quickly and easily change exercises that require a pushing exercise motion as opposed to a pulling motion, or a lift-up exercise motion as opposed to a pull-down motion.

SUMMARY

An example embodiment is directed to a reversible resistance exercise machine. The reversible resistance exercise machine includes a frame, a carriage movably positioned upon the frame, and a plurality of biasing members. A plurality of first tension connectors are accessible near the first end of the carriage and are adapted for removably attaching selected biasing members near the first end of the carriage to resist motion of the carriage in the first direction. A plurality of second tension connectors are accessible near the second end of the carriage and are adapted for removably attaching selected biasing members near the second end of the carriage to resist motion of the carriage in the second direction. A user selectable amount of force may be applied to the carriage to resist movement in either of the first direction and the second direction.

In specific embodiments, the biasing members comprise a resistance element, for example an extension spring, and are coupled to the carriage by a pulley assembly. In other specific embodiments, biasing members are equipped with first tension knobs accessible near a first end of the platform and second tension knobs accessible near a second end of the platform. The first and second tension knobs are selectively removably attachable to the platform at or near the first and second ends respectively to selectively resist movement of the platform in either of the first and second directions.

An exemplary alternative embodiment is directed to a reversible exercise machine arranged vertically with a longitudinal axis and having a trolley movable in first and second substantially opposed directions along the longitudinal axis. A similar arrangement of biasing members and connectors is incorporated so that a selectable amount of force may be applied to the trolley to resist movement in either direction. One or more handles are coupled to the trolley to permit a user to lift-up or pull-down the trolley in either of the first and second directions against the applied force.

The various embodiments of the present invention provide for a novel exercise machine comprising an exercise platform bi-directionally movable substantially the length of and parallel to one or more longitudinal rails against a user-adjustable biasing resistance towards a first end, or against a user-adjustable biasing resistance towards a second end. The various embodiments of the present invention teach substantially horizontal and vertical variations of the novel exercise machine.

There has thus been outlined, rather broadly, some of the embodiments of the reversible resistance exercise machine in order that the detailed description thereof may be better understood, and in order that the present contribution to the art may be better appreciated. There are additional embodiments of the reversible resistance exercise machine that will be described hereinafter and that will form the subject matter of the claims appended hereto. In this respect, before explaining at least one embodiment of the reversible resistance exercise machine in detail, it is to be understood that the reversible resistance exercise machine is not limited in its application to the details of construction or to the arrangements of the components set forth in the following description or illustrated in the drawings. The reversible resistance exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

An example reversible resistance exercise machine generally comprises a frame having a longitudinal axis and an exercise platform comprising a carriage or trolley movably positioned upon the frame. The platform is movable by a user performing an exercise in first and second substantially opposed directions along the longitudinal axis. A plurality of biasing members 218 are operative to provide a force resisting movement of the platform. A plurality of first connectors are accessible near a first end of the platform to allow a user to removably attach selected biasing members 218 at or near the first end of the platform to resist motion of the platform in the first direction. A plurality of second connectors are accessible near an opposite second end of the platform to allow a user to removably attach selected biasing members 218 at or near the second end of the platform to resist motion of the platform in the second direction. A user may thus select an amount of force to be applied to the platform to resist movement in either direction as desired for the exercise to be performed.

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments.

The phrase "biasing member" 218 is used herein to describe one or more connected components providing a means of inducing a resistance force of an exercise machine against which an exerciser must apply a greater muscle force to overcome. A "biasing member" 218 may therefore be an extension spring, elastic band, a weight, or any of a spring, elastic band or weight connected to a cable or linkage that redirects a force of one of more resistance-inducing components to a movable component (e.g. carriage, handles) used by an exerciser for performing an exercise against the resistance. A biasing member 218 may also comprise an electromechanical resistance device. The cables used in the various embodiments may be comprised of various elongated flexible members such as, but not limited to, metal cable, non-metal cable, rope, bands, chains and the like.

Figure 1:
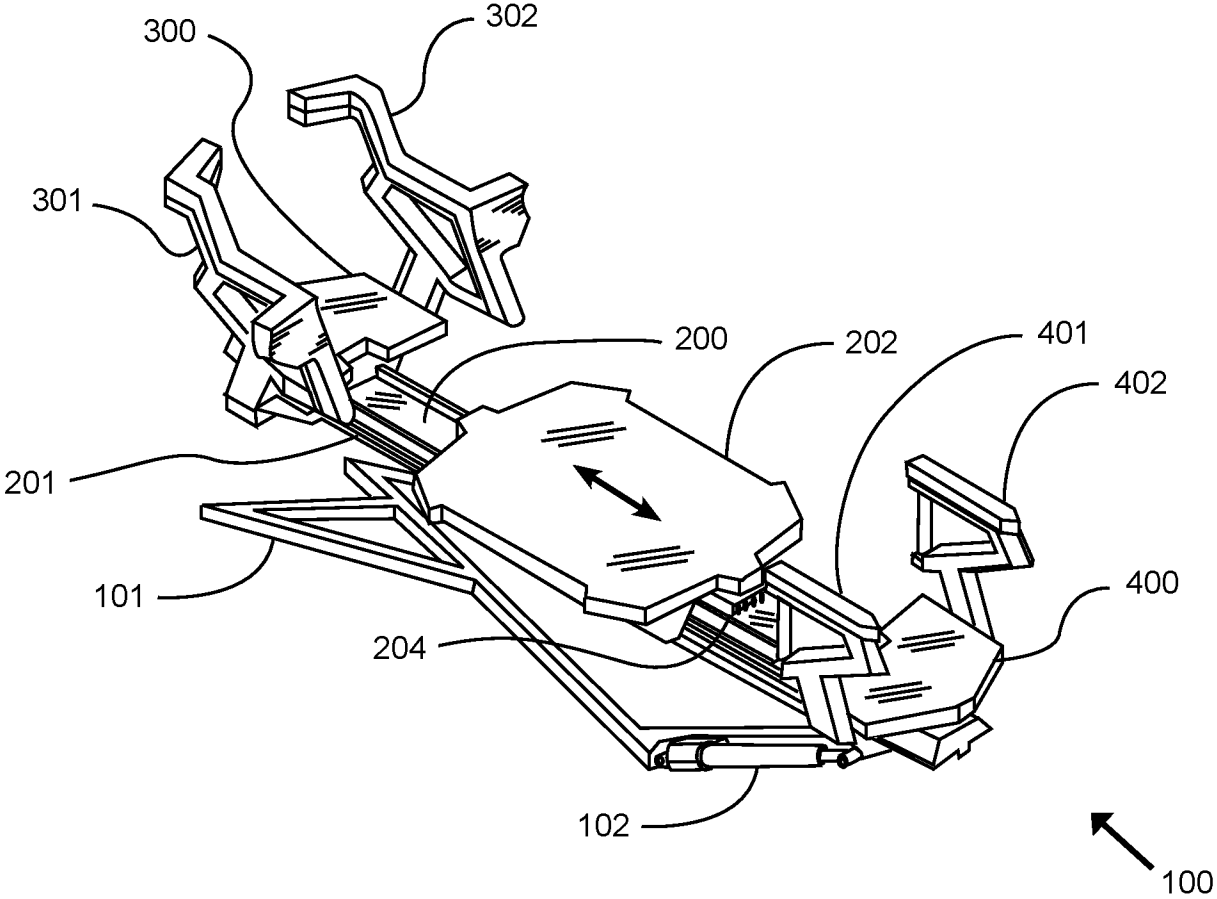
FIG. 1 is an exemplary diagram showing a perspective view of an improved exercise machine.

FIG. 1 is an exemplary diagram showing a perspective view of an improved exercise machine. In the drawing, an exercise machine 100 is comprised of a frame or base support structure 101 to which an upper structure is movably attached, the upper structure comprising one or more parallel trolley rails 201 laterally affixed to a central tubular monorail member 200, the monorail member and rails extending longitudinally substantially the length of the machine, and a front stationary 300 and at a back stationary platform 400. A movable carriage 202 is movably attached to the one or more longitudinal rails 201 and is movable substantially the length of the rails between the front and back stationary 300. The machine further comprises a front left handle assembly 301 and a front right handle assembly 302, and a left back handle assembly 401 and back right handle assembly 402, the handle assemblies providing for hand-gripping surfaces for an exerciser. A pair of actuators 102 provide for changing the plane of the upper structure from a horizontal plane by rolling the structure about the longitudinal axis, and/or tilting of the upper structure at an acute angle relative to the horizontal plane.

Exercise resistance is applied to the movable carriage 202 by removably attaching one or more of a plurality of front tension knobs 203 not shown, or one or more of a plurality of the back tension knobs 204 connected to extension springs 218 to a retainer bracket affixed to the movable carriage 202. The extension springs 218 may be removably connected to the carriage in various other manners.

Figure 2:
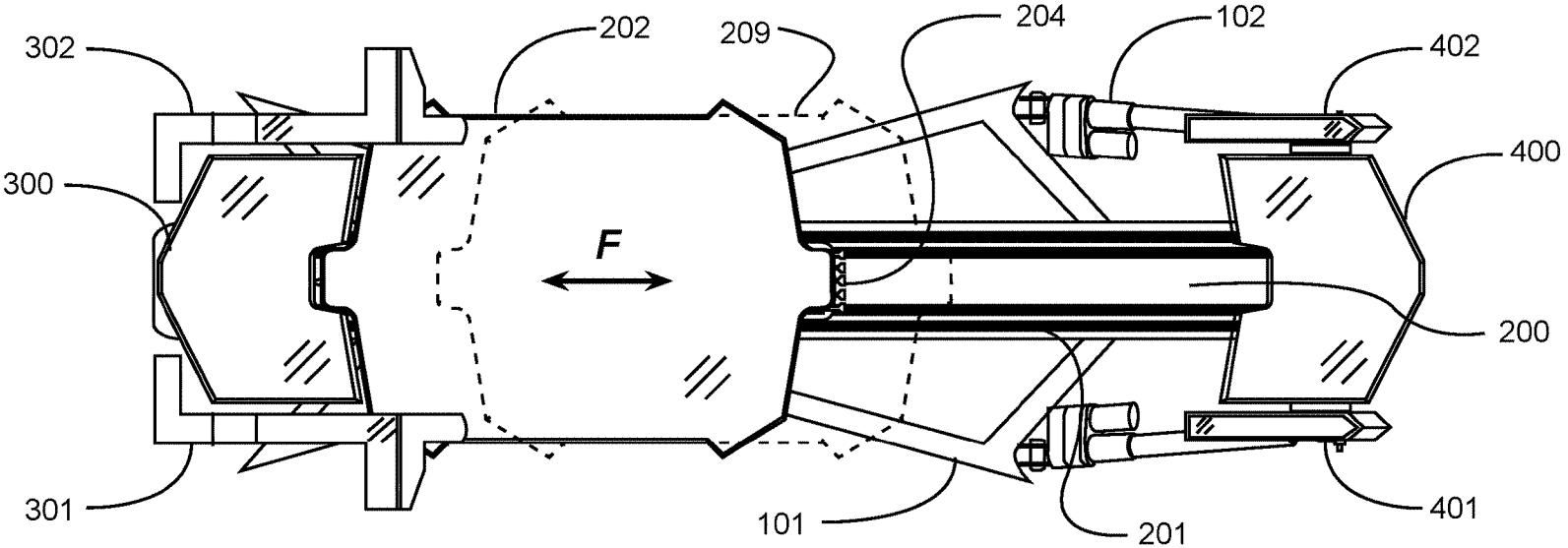
FIG. 2 is an exemplary diagram showing a top view of an improved exercise machine.

FIG. 2 is an exemplary diagram showing a top view of an improved exercise machine. In the drawing, a frame or base structure 101 is movably attached to an upper structure, the upper structure comprising one or more parallel trolley rails 201 laterally affixed to a central tubular monorail member 200, the monorail member and rails extending substantially the length of the machine, and a front stationary 300 and at a second back stationary platform 400, and a movable carriage 202 movably attached to the longitudinal rails 201, movable substantially the length of the rails between the front and back stationary platforms 300, 400. To illustrate the movement of the movable carriage, a dotted outline of the carriage 202 is shown moved slightly from the starting point near the stationary front platform 300, having been moved towards the stationary back platform 400. A pair of actuators 102 provide for changing the plane of the upper structure by lifting one end of the upper structure to an acute angle relative to the horizontal plane, and/or by rotating the upper structure about the longitudinal axis of the machine. A front left handle assembly 301 and a front right handle assembly 302, and a left back handle assembly 401 and back right handle assembly 402 provide for hand-gripping surfaces for an exerciser.

In practice, an exerciser removably attaches one or more back tension knobs 204 from a lower retainer bracket not shown, to an upper retainer bracket not shown but located on the back end of the movable carriage 202, and subsequently exerts a variable exercise force F against the movable platform in a direction opposed to the direction of the biasing resistance for example, the position indicated by the dashed outline 209 of the repositioned movable carriage 202. The exercise cycle is then continued by reciprocally moving the movable carriage against the biasing members 218 in a first direction opposed to the biasing direction, then with the biasing direction as referenced by the double-headed arrow. It should be noted that a second retainer bracket not shown is provided for on the front end of the movable carriage.

Figure 3:
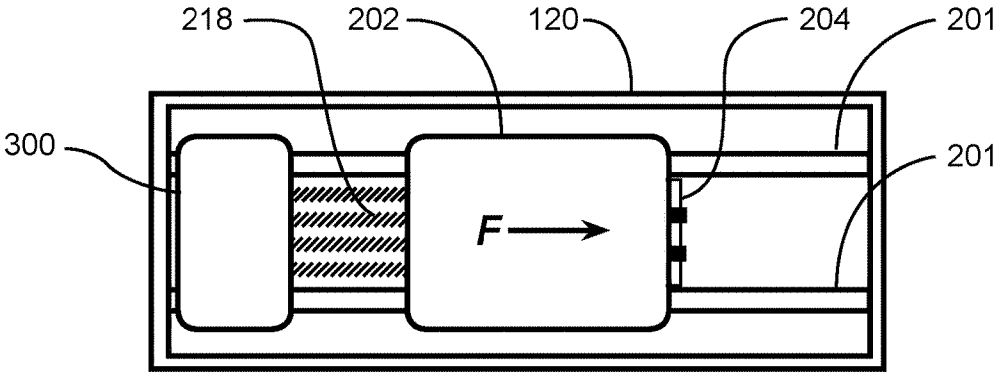
FIG. 3 is an exemplary diagram showing a top view of a traditional exercise machine.

FIG. 3 is an exemplary diagram showing a top view of a traditional exercise machine. More specifically, a Pilates apparatus is shown comprising a traditional Pilates machine frame 120 that supports a pair of parallel rails 201, and a non-movable end platform 300 at a first end, and a rolling carriage 202 movable upon the parallel rails 201. One or more resistance springs 218 securedly attached to the structure at the first end of the machine may be removably attached to the rolling carriage by relocating the distal end of the resistance springs from a keeper bracket not shown to a spring retainer bracket 204 affixed to the movable platform. After attaching at least one resistance spring between the structure 120 and retainer bracket 204 on the rolling carriage 202, an exerciser provides a force F against the rolling carriage in the direction shown, the exerted force being larger than the resistance force of the one or more resistance springs to thereby move the platform during an exercise. The resistance springs therefore provide for a unidirectional force against the rolling carriage in a direction towards the first end of the apparatus.

Figure 4:
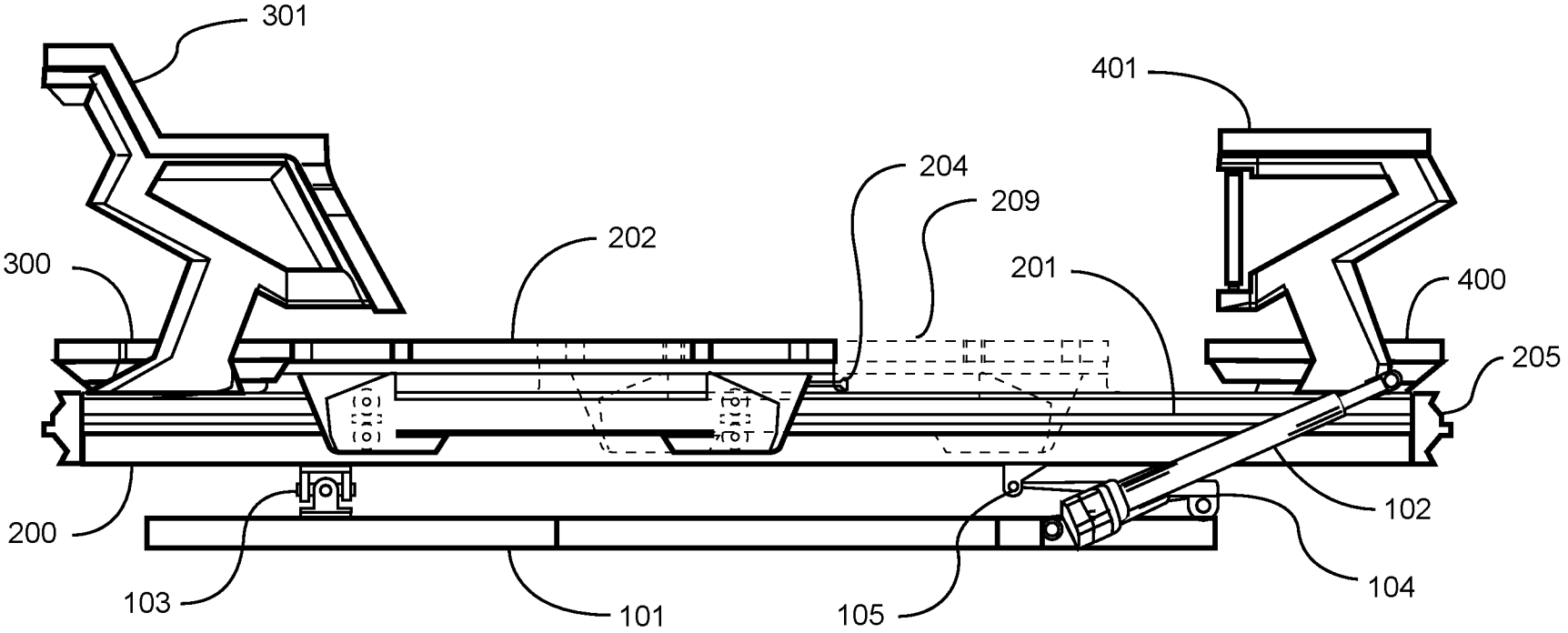
FIG. 4 is an exemplary diagram showing a side view of an improved exercise machine.

FIG. 4 is an exemplary diagram showing a side view of an improved exercise machine comprising a frame or base structure 101 with a first end of the upper structure supported by a supporting universal joint 103, and a second end of the upper structure supported by a stabilizing scissor 104 and pivotable upper structure support member 105. A pair of linear actuators 102 provide for lifting the back end of the upper structure at an acute angle relative to the horizontal plane, and further provide for rotating the upper structure about the longitudinal axis of the exercise machine. The upper structure is further comprised of one or more parallel trolley rails 201 extending longitudinally substantially the length of the machine, a front stationary platform 300, a back stationary platform 400, and a movable carriage 202 movably attached by means of a plurality of trolley assemblies to a pair of parallel trolley rails 201, the movable carriage rollable upon the rails substantially between the front stationary platform 300 and back stationary platform 400. A front left handle assembly 301 and a left back handle assembly 401 provides for hand-gripping surfaces for an exerciser. End caps 205 provide for closure of the substantially tubular monorail member 200 aligned with the longitudinal axis of the machine.

In practice, an exerciser removably attaches one or more back tension knobs 204 which are connected to biasing members 218 not shown to a retainer bracket on the back end of the movable carriage, and exerts an exercise force against the movable carriage in a direction towards the distal back end of the machine, for example, to a position indicated by the dashed outline of the repositioned carriage 209.

Figure 5B:
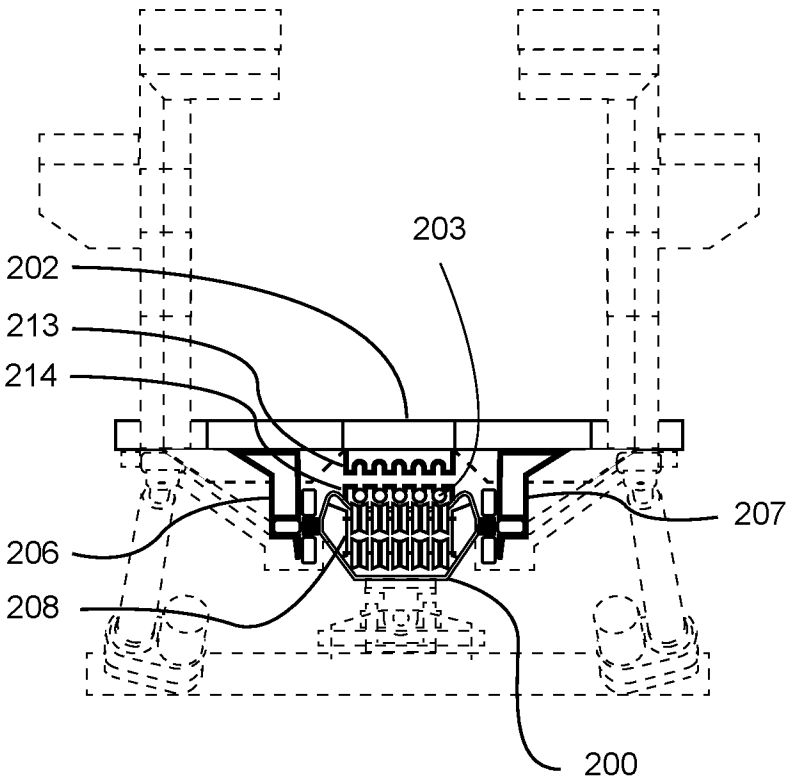
FIG. 5B is an exemplary diagram showing an end view of an exercise platform and a pulley of an improved exercise machine.
Figure 5A:
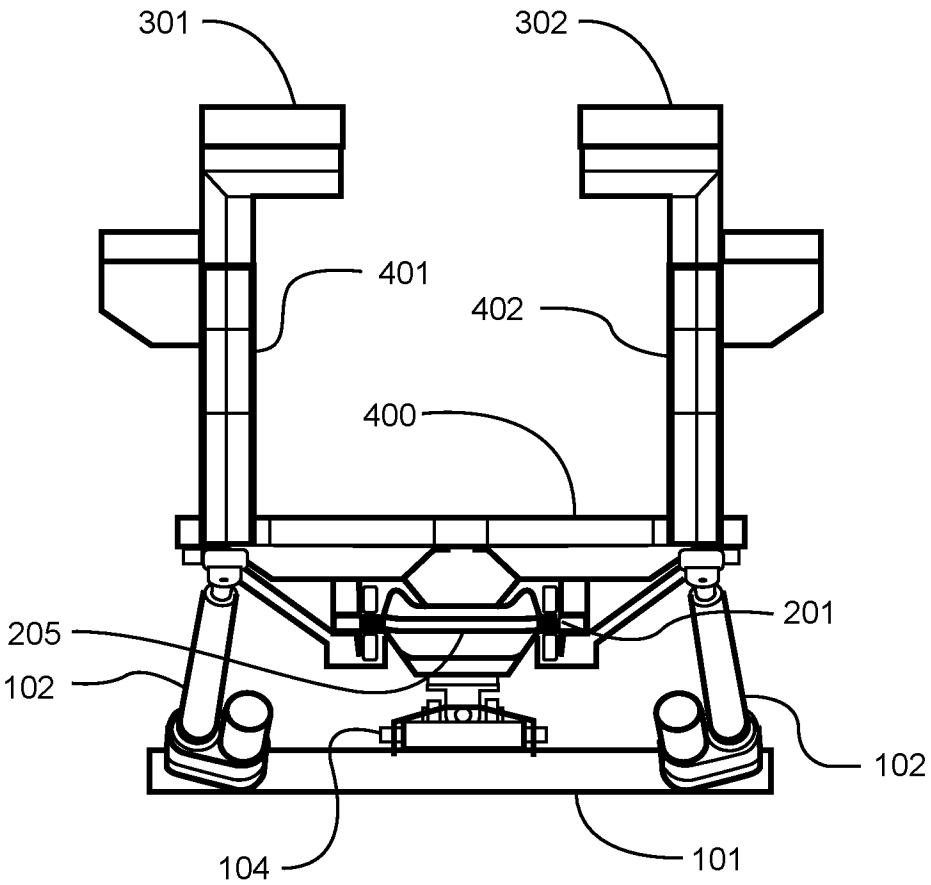
FIG. 5A is an exemplary diagram showing an end view of an improved exercise machine.

FIG. 5A is an exemplary diagram showing an end view of the back end of an improved exercise machine. A stabilizing scissor 104 movably attached to the frame or base structure 101 provides support for a central tubular monorail member 200 comprising a pair of parallel trolley rails 201 affixed laterally to, and aligned with the longitudinal axis of the monorail member. An end cap 205 is shown on the proximal end of the tubular monorail structure. A pair of linear actuators 102 provides for lift and rotational tilt of the upper horizontal plane of the upper structure and back stationary platform 400, and concurrently the front stationary platform and movable carriage not shown. A proximal left back handle assembly 401 and right back handle assembly 402, and a distal left front handle assembly and distal right front handle assembly 302 provide for hand-gripping surfaces for an exerciser.

FIG. 5B is an exemplary diagram showing an end view of an exercise platform and a pulley of improved exercise machine. For clarity, the end cap (205, FIG. 5A) has been removed, and the base structure, scissor stabilizer, linear actuators, handle assemblies, and back stationary platform are shown for reference by the dashed outline of the components just described.

In the drawing, the end view of a pulley cassette 208 contained within the tubular monorail member 200 with an upper set of a plurality of pulleys, and a lower set of a plurality of pulleys. The term "pulley cassette" is not meant to be limiting, and is merely used to reference an assembly comprising a plurality of pulleys. However, in some instances, the plurality of pulleys may be affixed directly or indirectly to the structure of an improved exercise machine.

The upper portion of the pulley cassette protrudes through the upper surface of the tubular monorail member providing for an exerciser to attach one or more of a plurality of biasing members 218 to the movable carriage 202. Each end of each biasing member 218 is terminated with a knob, each of the knobs when unused being retained in a designated location within a lower knob retainer bracket 214, said bracket being affixed directly or indirectly to the upper surface of the tubular monorail member.

The stationary platform of the second end, having been removed for clarity, reveals the proximate edge of the movable carriage 202 and the proximate upper knob retainer bracket 213. In practice, an exerciser relocates one or more knobs that terminate one end of a biasing member 218 from the lower knob retainer bracket 214 to the upper knob retainer bracket 213, thereby transferring the biasing force from a zero setting against the movable carriage 202 while the knobs are retained in the lower knob retainer bracket 214 to a dynamic force exerted upon the movable carriage when positioned in the upper knob retainer bracket 213. One back upper knob retainer bracket 213 is affixed substantially to the proximate end of the movable carriage 202, and one front upper knob retainer bracket not shown, but which is a mirror image of the back knob retainer bracket 213 is affixed substantially to the opposed end of the movable carriage 202.

Figure 6A:
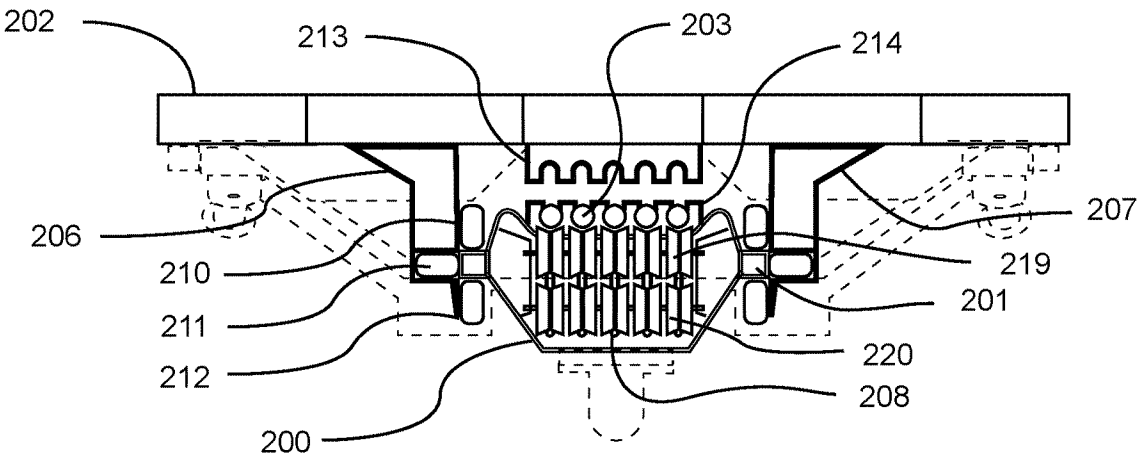
FIG. 6A is an exemplary diagram showing an end view of an exercise platform and a pulley of an improved exercise machine with no biasing member engagement.

FIG. 6A is an exemplary diagram showing an back end view of a movable carriage 202 and a pulley cassette 208 of the improved exercise machine, with no biasing member engagement. More specifically, the back end view of a pulley cassette 208 is shown as affixed within the interior space of a tubular monorail member 200, the cassette comprising a plurality of upper pulleys 219 and lower pulleys 220. So as not to obscure the primary elements of the biasing members 218, certain components of the machine are shown as dashed lines for reference. It should be noted the each biasing member preferably comprises two upper pulleys, a front upper pulley, and a back upper pulley but may have any number of pulleys and may not include any pulleys.

Parallel trolley rails 201 are positioned on opposed sides of the monorail member. The movable carriage 202 engages the rails by means of a plurality of left trolley assemblies 206 and right trolley assemblies 207. Each trolley assembly comprises at least one upper trolley wheel 210 rolling substantially upon the upper surface of the rails 201, one horizontally positioned trolley wheel 211 rolling substantially upon the lateral vertical surface of the rails, and a lower trolley wheel 212 rolling substantially upon the lower horizontal surface of the parallel trolley rails providing a counter force to uplift forces placed upon the movable carriage.

One back upper knob retainer bracket 213 is affixed substantially to the proximate end of the movable carriage 202, the retainer bracket being used to retain removably attachable one or more knobs 204 and corresponding biasing members 218 to the movable carriage, thereby applying a resistance force to the platform substantially equal to the sum of the resistance forces of the attached biasing members 218. When the biasing members 218 are not engaged with the back upper knob retainer bracket 213, they are retained by a back lower knob retainer bracket 214, the lower retainer bracket being affixed directly or indirectly to the upper surface of the tubular monorail member.

Figure 6B:
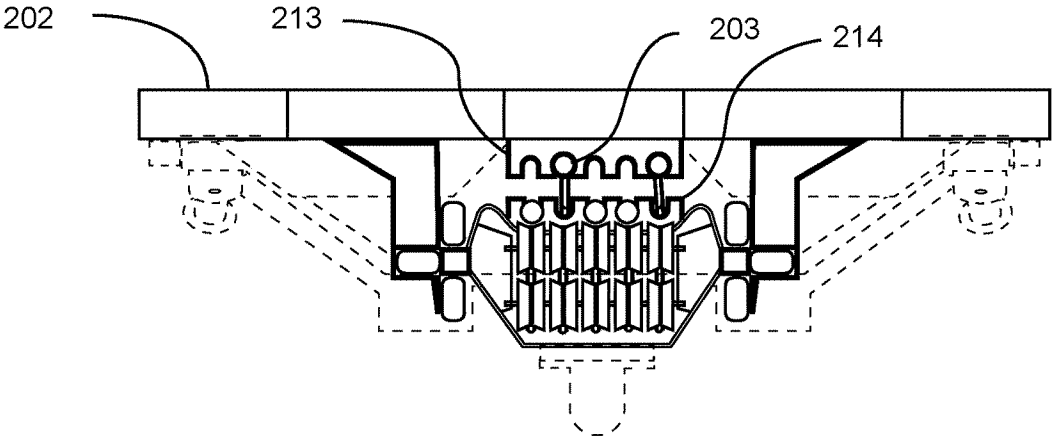
FIG. 6B is an exemplary diagram showing an end view of an exercise platform and a pulley of an improved exercise machine with engagement of two biasing members.

FIG. 6B is an exemplary diagram showing an end view of an exercise platform and a pulley cassette of improved exercise machine with engagement of two biasing members 218. Each end of each biasing member is terminated with a knob 204, each of the knobs being initially retained in a designated location as just described within a position within the lower knob retainer bracket 214 that is affixed directly or indirectly to the upper surface of the tubular monorail member. Each knob may be readily moved by the exerciser from the lower to upper retainer bracket as a means to increase resistance, or the exerciser may move the knob from the upper retainer bracket to the lower as a means to reduce the resistance. Each knob is substantially the terminal end of each end of a biasing member 218.

In the drawing, as one illustrative example of increasing the resistance force applied to the movable carriage 202, two knobs 204 are shown having been repositioned from the lower knob retainer bracket 214 to the upper knob retainer bracket 213. Any of the knobs may be moved between the upper and lower retainer brackets at any time, and in any order. In the instant example, each of the knobs may be connected to biasing members 218 representing twenty-five pounds of force. Together, the two knobs represent a resistance force that will be applied to the movable carriage equal to fifty pounds. It should be noted that the biasing force of extension springs is not constant, but rather variable relative to the length of extension of the springs in accordance with Hooke's Law.

Figure 7:
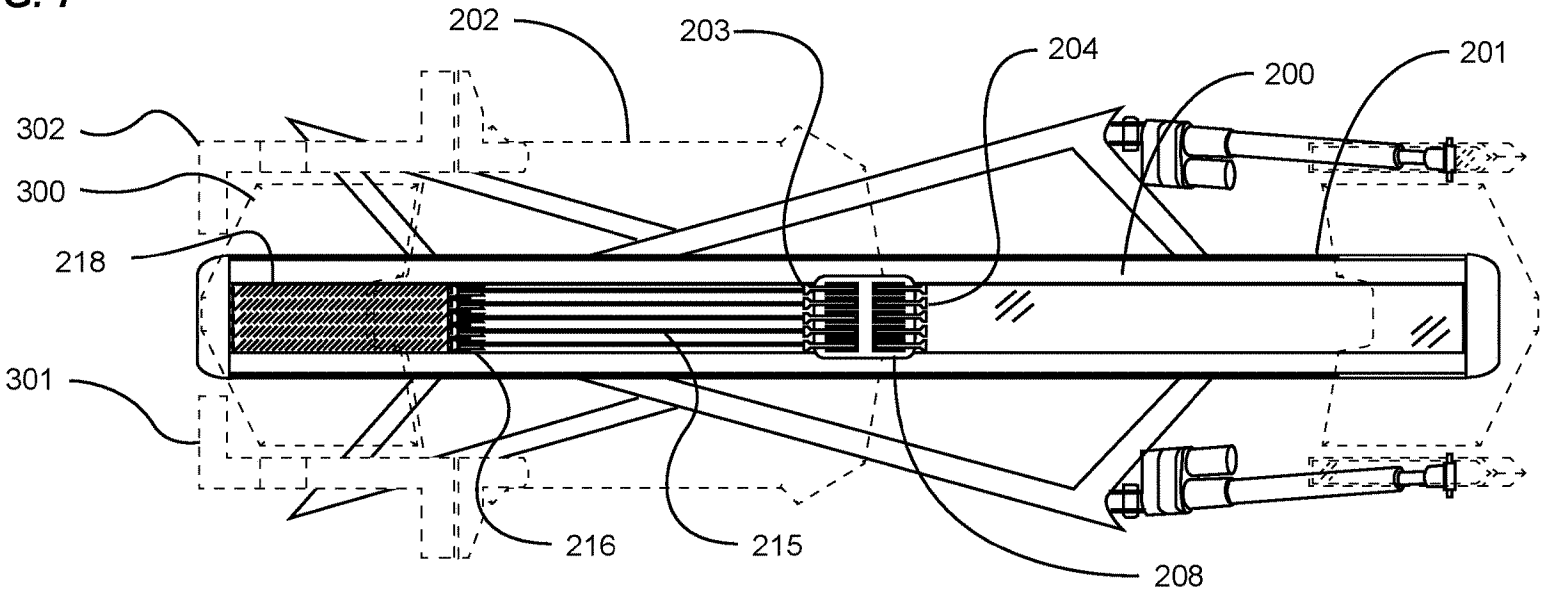
FIG. 7 is an exemplary diagram showing a top view of the interior of the longitudinal tubular monorail member of an improved exercise machine with the top cover removed, revealing resistance biasing members secured to the structure of the first end.

FIG. 7 is an exemplary diagram showing a top view of the interior of the longitudinal tubular monorail member of an improved exercise machine with the top cover removed, revealing resistance biasing members 218 secured to the structure of the front end. Components of the exercise machine previously described but which are positioned substantially above the parallel rails 201 include at least a stationary front platform 300, a pair of front handle assemblies 301, 302, and a movable carriage 202.

The drawing shows the revealed internal components of a reversible tension system comprising a pulley cassette 208, a plurality of looped cables 215 with one end of each looped cable terminated with front tension knob 203 and the opposed end of the looped cable terminated with a back tension knob 204, the just described cables each passing through a return pulley 216, each pulley affixed to a back end of at least one extension spring 218. Each just described biasing member comprising at least one looped cable with terminal tension knobs, a return pulley, and one extension spring. As can be readily seen, the plurality of the biasing members 218 are arranged within the interior of the tubular monorail member 200 with the front end of each of the springs affixed substantially to the front end of the machine. The plurality of tension knobs 203, 204 are retained by lower retainer brackets as previously described, the retainer brackets integral with or proximate to the pulley cassette 208. In practice, an exerciser would relocate one or more of the front tension knobs 203 or back tension knobs 204 from the retainer bracket just described to one of two upper retainer brackets not shown, said upper retainer brackets being proximate to the front end or back end of the movable carriage 201.

Figure 8:
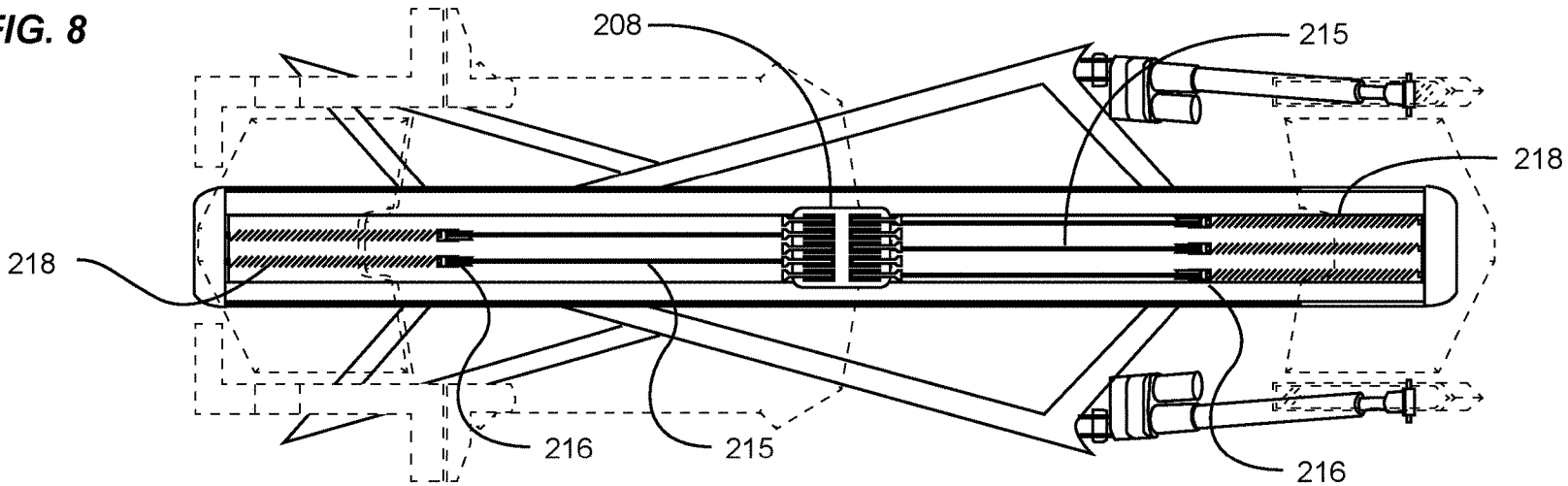
FIG. 8 is an exemplary diagram showing a top view of the interior or the longitudinal tubular monorail member of an improved exercise machine with the top cover removed, revealing alternating resistance biasing members secured to the structure of the first and second ends.

FIG. 8 is an exemplary diagram showing a top view of the interior of the longitudinal tubular monorail member of an improved exercise machine with the top cover removed, revealing alternating resistance biasing members 218 secured to the structure of the first and second ends. As a variation to the arrangement of the biasing members 218 as just described in FIG. 7, the drawing shows the exposed internal components of a reversible tension system comprising a pulley cassette 208, a plurality of looped cables 215 extending from the cassette towards the front end of the machine, and a plurality of looped cables 215 extending from the pulley cassette towards the opposed back end of the machine, each end of each cable terminated with a previously described knob, the cables 215 each passing through a return pulley 216, each pulley affixed to a movable end of at least one extension spring 218. The variation of the tensioning system with biasing members 218 affixed to the two opposed ends of the machine as just described provides for a larger number of biasing members 218 to be installed within a given width of the interior space of the tubular monorail member, and/or provides for the use of larger diameter springs as a means to increase the resistance force of each biasing member 218.

Figure 9:
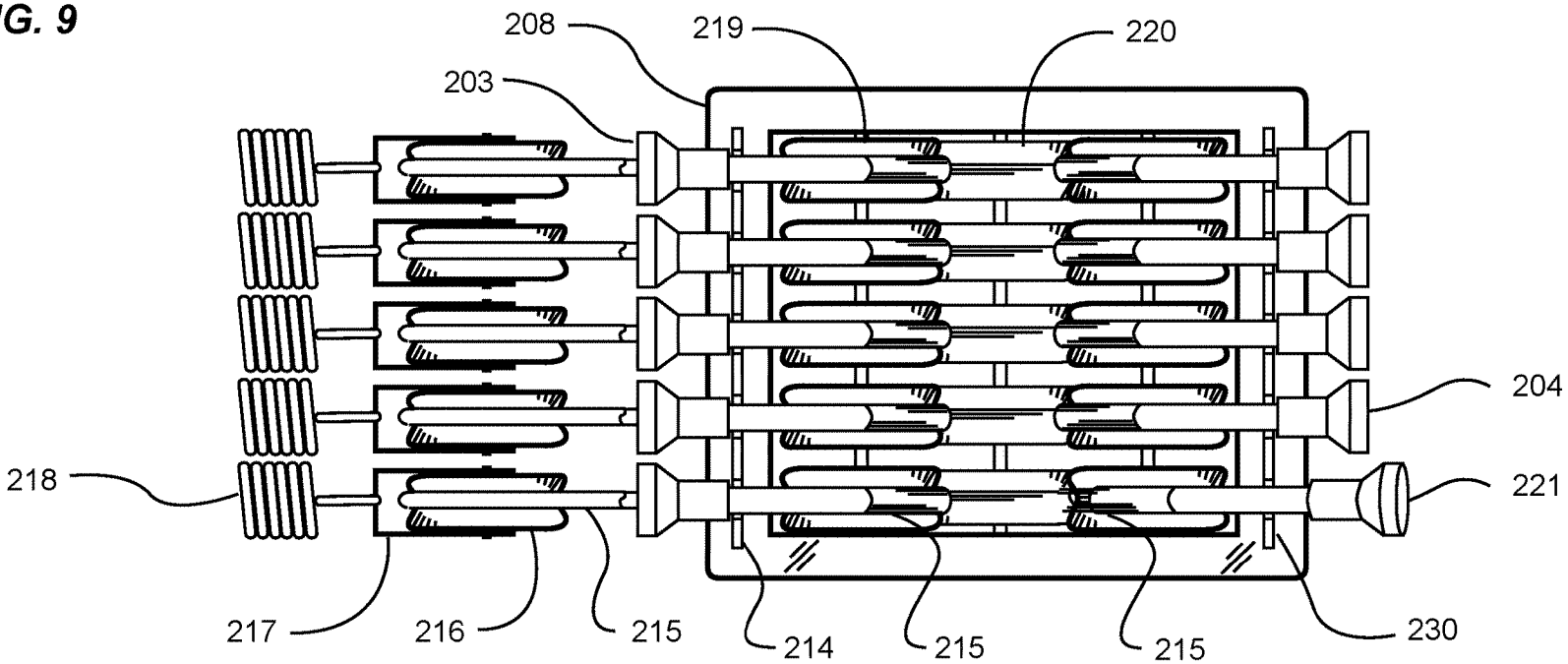
FIG. 9 is an exemplary diagram showing a top view of a pulley of an improved exercise machine.

FIG. 9 is an exemplary diagram showing a top view of a pulley cassette 208 of an improved exercise machine comprising a plurality of upper pulleys 219, one row of a preferred number of upper pulleys aligned with the axial centers positioned on a preferred single axle proximal to the front end, and an equal preferred number of upper pulleys aligned with the axial centers positioned on a preferred single axle proximal to the back end. A single row of an equal preferred number of lower pulleys 220 aligned with the axial centers is positioned on a preferred single axle below and substantially centered between the rows of upper pulleys.

The pulley cassette just described provides for the retention of removably retained knobs of the biasing members 218. Specifically, each biasing member is comprised of a front knob 203 affixed to a first end of a looped cable 215 which is threaded over and wrapped around a preferred sector of the circumference of one upper pulley, continuing to and wrapped substantially about half of the circumference of a return pulley 216, continuing to and wrapped about a quarter sector of the circumference of a lower pulley 220, continuing upwardly and threaded through and wrapped around a preferred sector of a second upper pulley, the second end of the looped cable being terminated with a second knob 204. A biasing force is exerted upon each looped cable by means of at least one extension spring 218, one end of each extension spring securedly affixed to the exercise machine structure not shown, and the opposed end affixed to a return pulley shackle 217 comprising an axle passing through and rotatably securing one return pulley 216.

When the movable carriage of the exercise machine is in a neutral, non-biased state, all of the knobs 203, 204 are removably retained in respective positions within a front and back knob retainer bracket 214. One back tension knob 221 is shown in a state of being repositioned off of the back lower knob retainer bracket 214.

Figure 10:
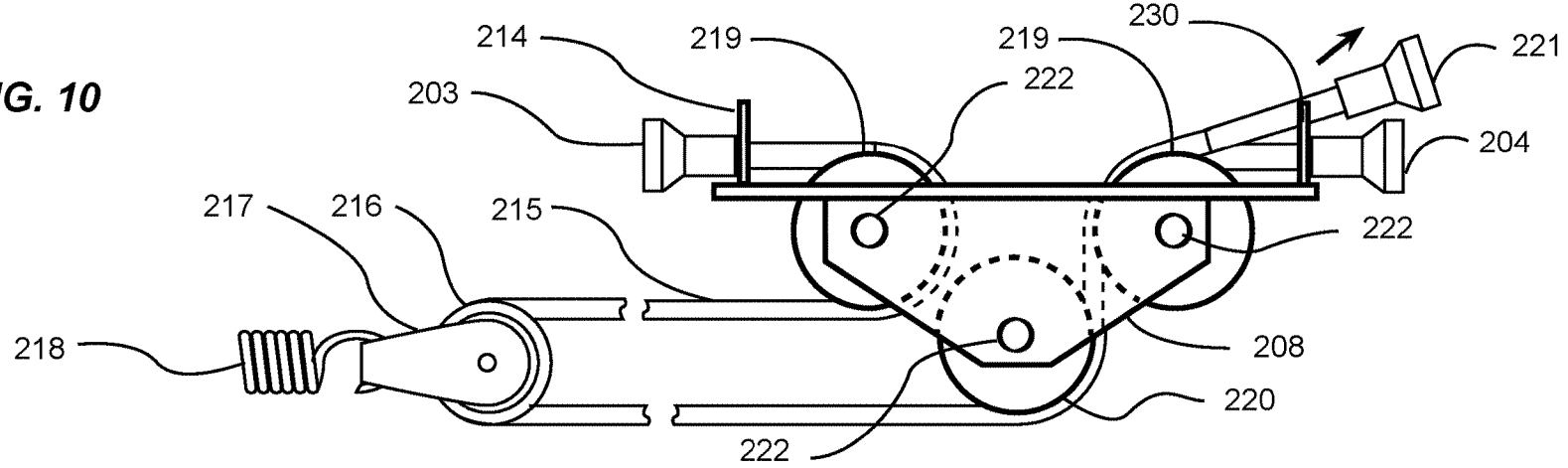
FIG. 10 is an exemplary diagram showing a side view of a pulley of an improved exercise machine.

FIG. 10 is an exemplary diagram showing a side view of a pulley cassette of an improved exercise machine comprising a plurality of upper pulleys 219, one row of a preferred number of upper pulleys aligned with the axial centers positioned on a preferred single axle 222 proximal to the front end, and an equal preferred number of upper pulleys aligned with the axial centers positioned on a preferred single axle 222 proximal to the back end. A single row of an equal preferred number of lower pulleys 220 aligned with the axial centers is positioned on a preferred single axle 222 below and substantially centered between the rows of upper pulleys.

The pulley cassette just described provides for the retention of removably retained knobs of the biasing members 218, each biasing member comprised of a front knob 203 retained in a front lower retainer bracket 214 and affixed to a first end of a looped cable 215 which is threaded over and wrapped around a preferred sector of the circumference of one upper pulley 219, continuing to and wrapped substantially about half of the circumference of a return pulley 216, continuing to and wrapped about a quarter sector of the circumference of a lower pulley 220, continuing upwardly and threaded through and wrapped around a preferred sector of a second upper pulley 219, the second end of the looped cable being terminated with a second knob 204 retained within a back lower retainer bracket 230. Each return pulley is secured to a return pulley shackle 217 to which a movable end of at least one extension spring 218 is secured.

When an exerciser desires a resistance force be exerted upon a movable platform not shown, the exerciser relocates at least one of the front or back tension knobs 203, 204 from the respective lower retainer bracket 214, 230 to an upper retainer bracket 213, 232 on the movable carriage. One back tension knob 221 is shown in a state of being repositioned off of the back lower knob retainer bracket 214.

Figure 11:
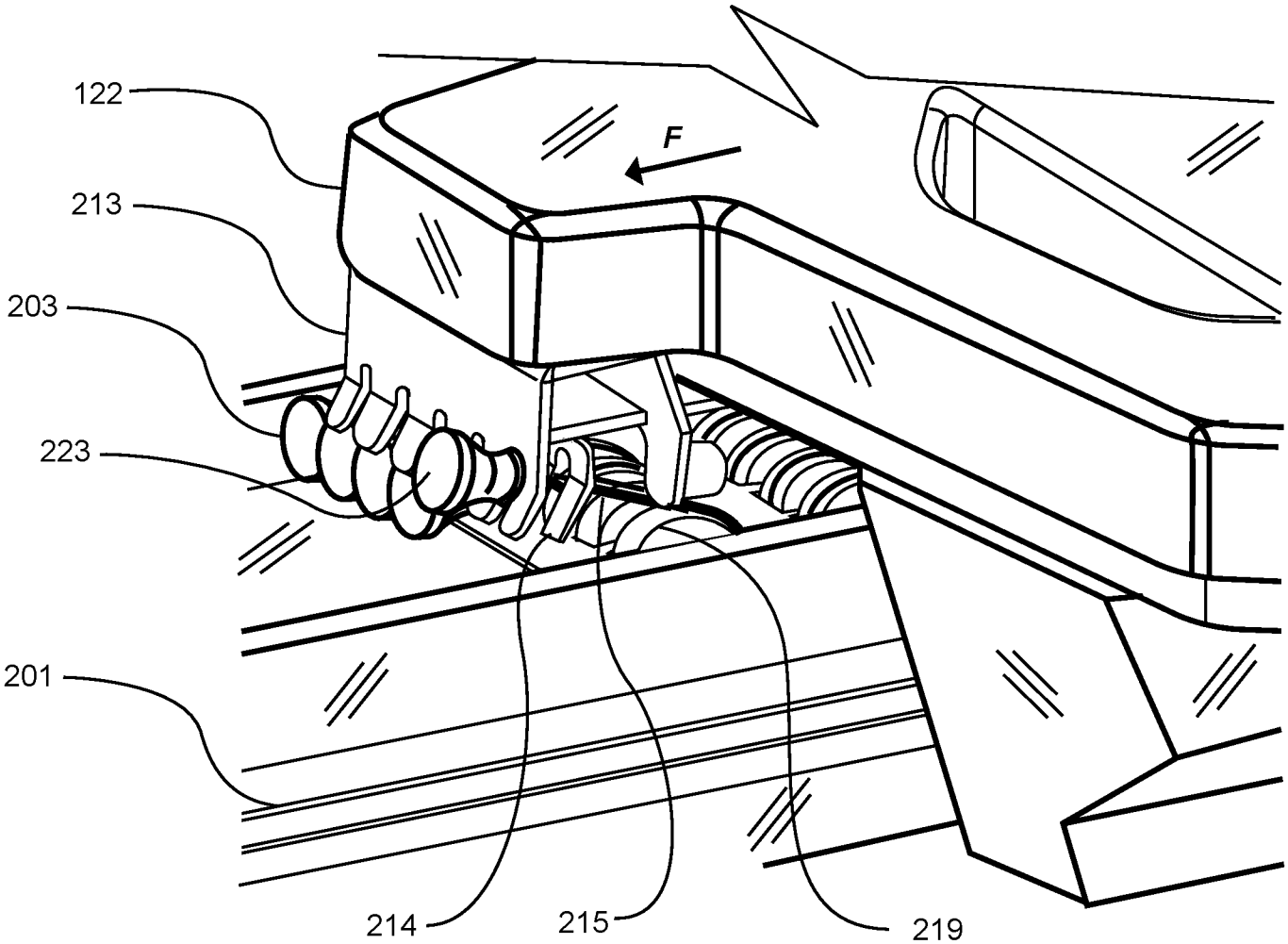
FIG. 11 is an exemplary diagram showing a perspective view of the front tension knobs and upper retainer bracket affixed to a portion of a removable carriage of an improved exercise machine.

FIG. 11 is an exemplary diagram showing a perspective view of the front tension knobs and upper retainer bracket affixed to a portion of a movable carriage. A movable carriage 122 moves longitudinally parallel to a pair of parallel trolley rails 201, the movable carriage being shown with an upper knob retainer bracket 213 with one repositioned front tension knob 223 having been transferred by an exerciser from the lower knob retainer bracket 214. Four front tension knobs 203 are shown retained on the lower knob retainer bracket 214. A looped cable 215 being affixed to a front tension knob is shown wrapping a portion of an upper pulley 219. As the movable carriage is moved in the direction of the exerciser force F, the upper knob retainer bracket pulls with it the repositioned front tension knob and, correspondingly the affixed looped cable 219 which extends the extension spring not shown.

Figure 12:
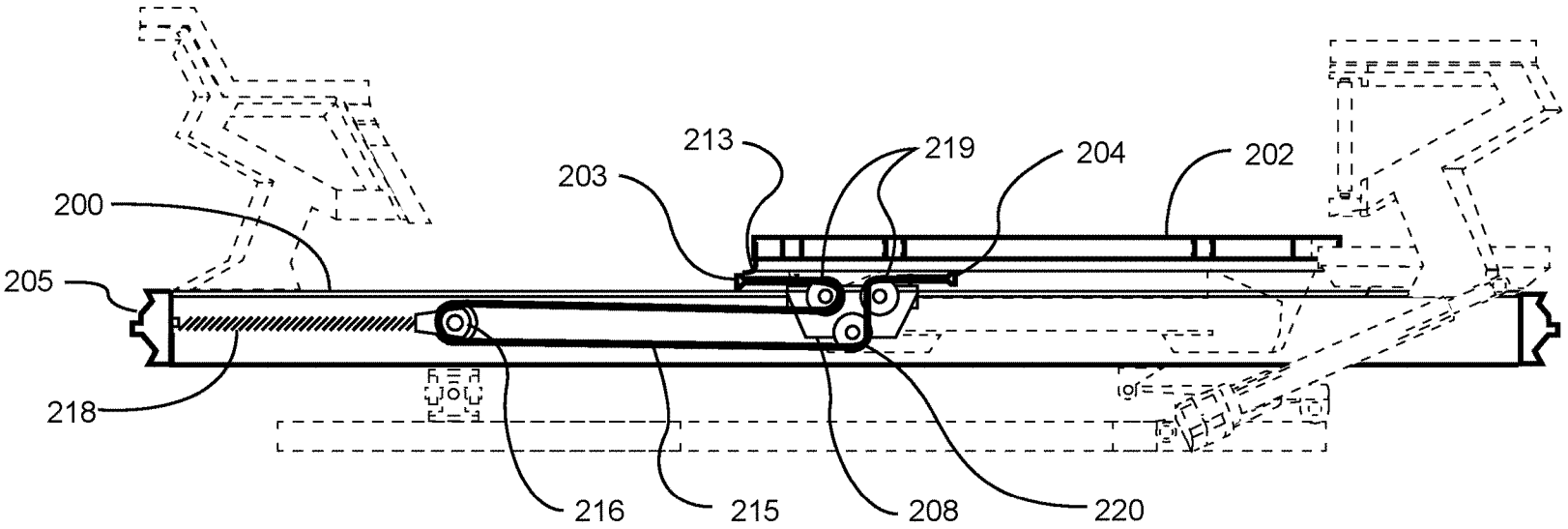
FIG. 12 is an exemplary diagram showing a side view of a section through the longitudinal center of an improved exercise machine.

FIG. 12 is an exemplary diagram showing a top view of a section through the longitudinal center of an improved exercise machine. So as to not obscure the important elements of the biasing members 218, certain components are shown as dashed lines merely for positional reference.

A tubular monorail member 200 with opposed end caps 205 extends longitudinally substantially the length of the exercise machine and provides for an internal open space of sufficient dimension and volume to enclose a plurality of biasing members 218 and a substantial portion of a pulley cassette 208, the cassette being comprised of two rows each of a plurality of upper pulleys 219, and one row of a plurality of lower pulleys 220. A plurality of biasing members 218 are each comprised of a front tension knob 203 securedly affixed to one end of a looped cable 215 that wraps substantially around a return pulley 216 and which returns to wrap through a lower and upper pulley 220, 219 with a second cable end securedly affixed to a back tension knob 204. An extension spring 218 extends from a front end affixed proximate to a front end cap 205 to a pulley shackle and return pulley 216.

In one example, when an exerciser desires to add tension in a first direction to a movable carriage 202 positioned substantially at the back end of the machine, they reposition at least one front tension knob 203 from the lower retainer bracket previously described, to an upper retainer bracket 213 affixed to the front end of a movable carriage 202.

Figure 13:
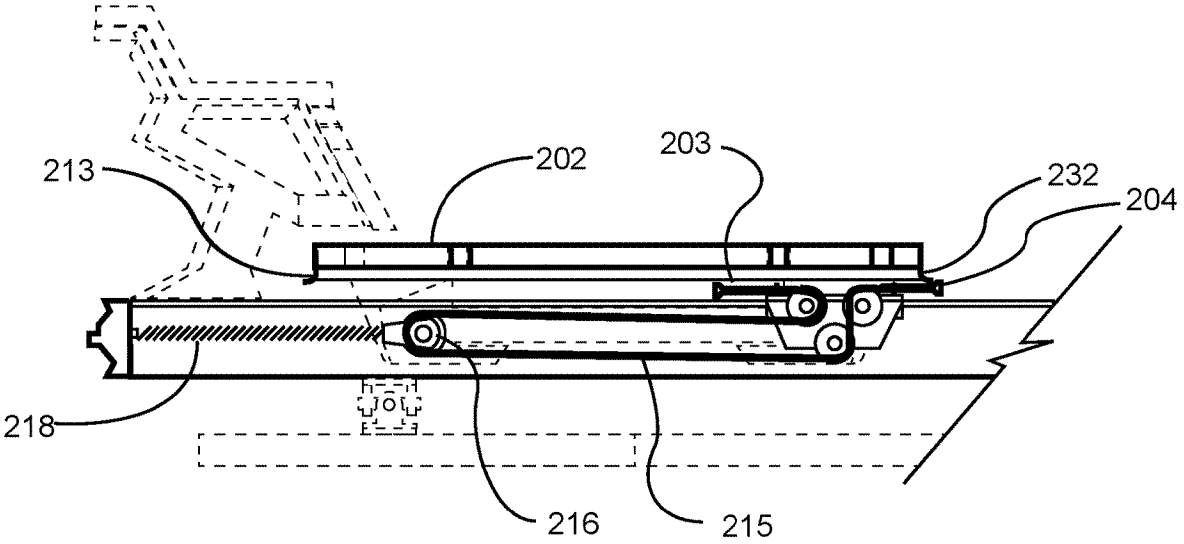
FIG. 13 is an exemplary diagram showing a side view of a section through the longitudinal center of an improved exercise machine.

FIG. 13 is an exemplary diagram showing a top view of a section through the longitudinal center of an improved exercise machine. To illustrate a means of applying a resistance bias to a movable platform in a direction opposed to the resistance direction applied to the carriage of FIG. 11, the drawing shows a movable carriage 202 positioned substantially at the front end of the exercise machine. At least one biasing member comprises a front tension knob 203, a looped cable 215, a return pulley 216, extension spring 218, and a back tension knob 204. The resistance force provided by the biasing member just described is applied to the back end of the movable carriage 202 when an exerciser repositions a back tension knob 204 from the lower retainer bracket to the upper retainer bracket 213 on substantially the back end of the movable carriage 202.

Figure 14A:
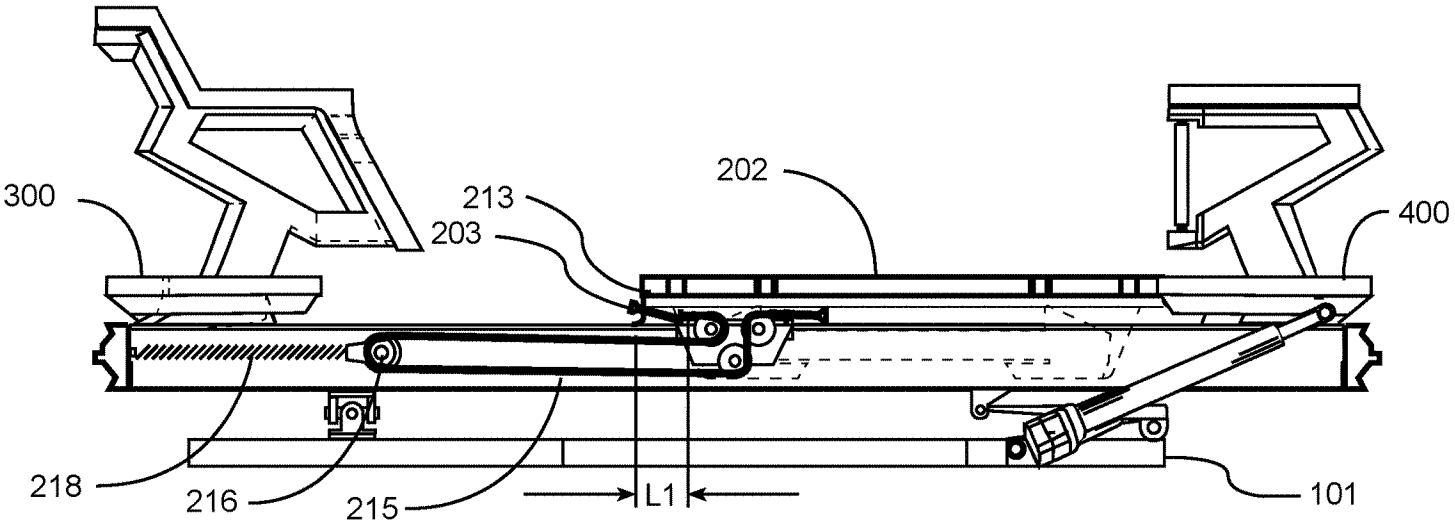
FIG. 14A is an exemplary diagram showing a side view of a section through the longitudinal center of an improved exercise machine with a movable carriage positioned at the back end for exercising.

FIG. 14A is an exemplary diagram showing a side view of a section through the longitudinal center of an improved exercise machine with a movable carriage 202 positioned at the back end for exercising. Starting with the movable carriage in said position will require an exerciser to apply force to the movable carriage in a direction towards the front end of the machine.

More specifically, a tubular monorail member 200 is supported above the floor by a frame or base support structure 101 and various other components previously described. A movable carriage 202 is first positioned proximate to a back stationary platform 400. In such position, the upper knob retainer bracket 213 at the front of the carriage is positioned substantially above and aligned with the front tension knobs 203 that are retained by the lower knob retainer bracket as previously described. It can be readily seen that the distance between the retaining shoulder of the front tension knob 203 prior to exercising is a preferred L1 from the proximate upper pulley. The knob 203, once removably attached to the upper retainer bracket 213 will move with the movable carriage in a direction towards the stationary front platform 400, correspondingly pulling the looped cable 215 through the return pulley 216 which extends the extension spring 218 as the resistance means.

Figure 14B:
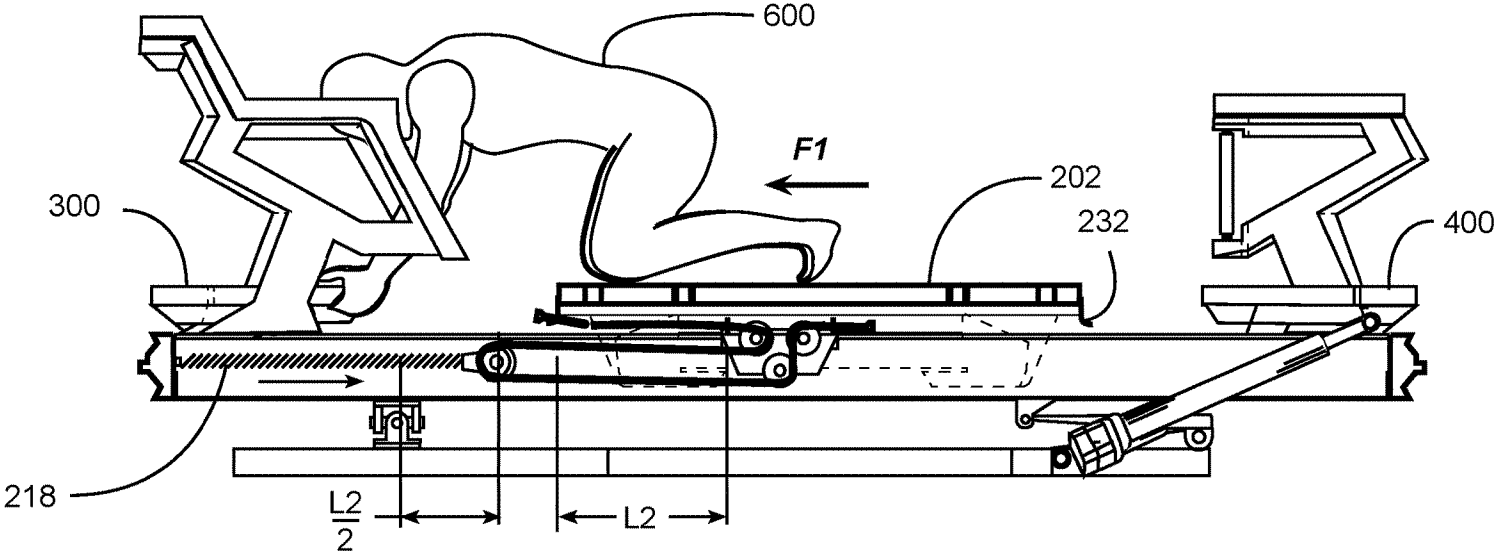
FIG. 14B is an exemplary diagram showing a side view of a section through the longitudinal center of an improved exercise machine being operated by an exerciser.

FIG. 14B is an exemplary diagram showing a side view of a section through the longitudinal center of an improved exercise machine being operated by an exerciser 600. The exerciser, being first positioned upon the carriage in the starting position of FIG. 13A grasps the stationary front platform 300 and performs the exercise by pulling the carriage in a direction and with a force of F1 in excess of the resistance force of the biasing members 218. As the carriage 202 moves toward the stationary front platform 300, it pulls with it the one or more front tension knobs 203 which are removably attached to the upper retainer bracket on the carriage. By moving the carriage a distance from the starting point, the distance being the difference between the starting distance (L1. FIG. 13A) and the distance L2. The looped cable 215 wrapped through the return pulley extends the extension spring 218 a distance of L2÷2.

Figure 15A:
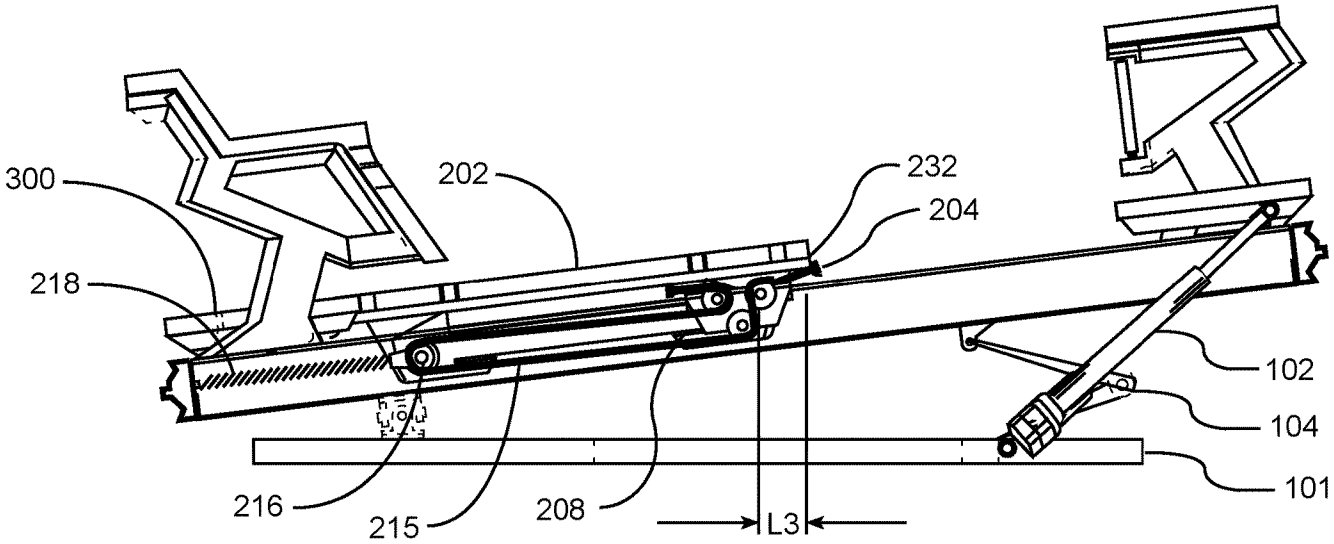
FIG. 15A is an exemplary diagram showing a side view of a section through the longitudinal support structure of an improved exercise machine with biasing members engaged.

FIG. 15A is an exemplary diagram showing a side view of a section through the longitudinal support structure of an improved exercise machine with biasing members 218 engaged. More specifically, in the starting position of the illustrative example the back end of the upper structure is raised at an acute angle relative to the substantially horizontal base structure 101 by extending a pair of actuators 102, the upper structure being stabilized by a stabilizing scissor 104. A movable carriage 202 is positioned proximate to the stationary front platform 300 such that the upper knob retainer bracket 213 at the back of the carriage is positioned substantially above and aligned with the back tension knobs 204 that are retained by the lower knob retainer bracket as previously described. A looped cable 215 extends from the back tension knob 204 through the pulley cassette 208 as previously described, wrapping around the return pulley 216. The distance between the retaining shoulder of the back tension knob 204 prior to exercising is a preferred L3 from the proximate upper pulley.

Figure 15B:
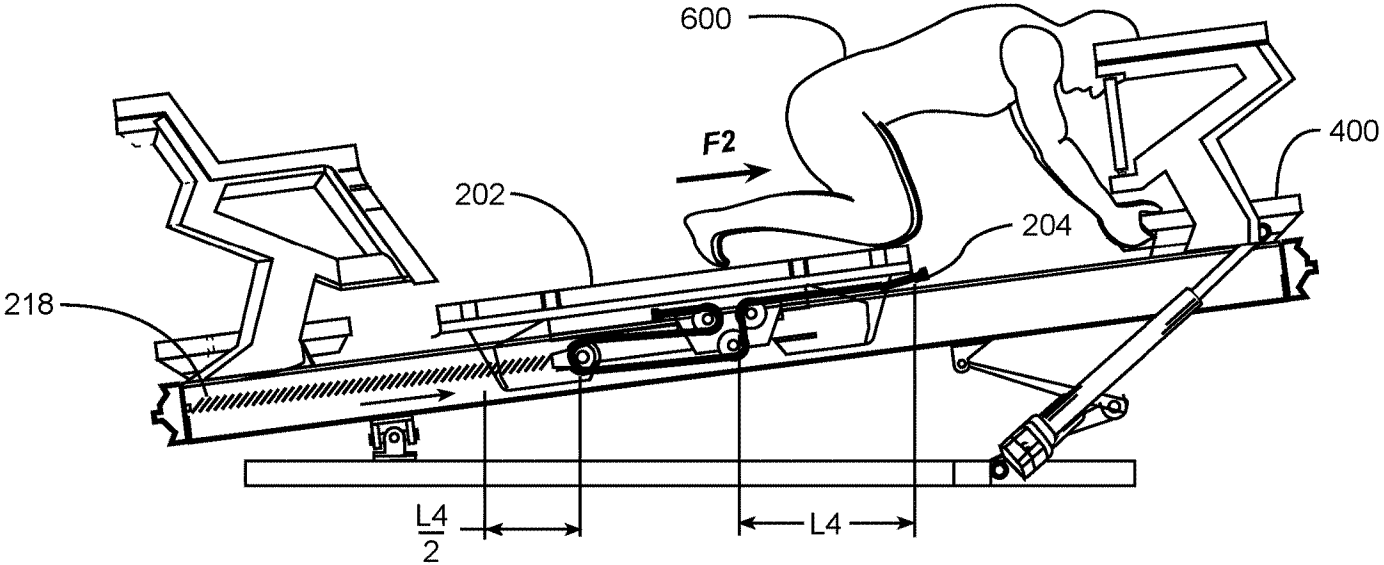
FIG. 15B is an exemplary diagram showing a side view of a section through the longitudinal support structure of an improved exercise machine being operated by an exerciser.

FIG. 15B is an exemplary diagram showing a side view of a section through the longitudinal support structure of an improved exercise machine being operated by an exerciser 600. The exerciser, being first positioned upon the carriage in the starting position of FIG. 14A grasps the stationary back platform 400 and performs the exercise by pulling the carriage in a direction and with a force of F2 in excess of the resistance force of the biasing members 218. As the carriage 202 moves toward the stationary back platform 400, it pulls with it the one or more back tension knobs 204 which are removably attached to the upper retainer bracket on the carriage. By moving the carriage a distance from the starting point, the distance being the difference between the starting distance (L3, FIG. 14A) and the distance L4. The looped cable 215 wrapped through the return pulley extends the extension spring 218 a distance of L4÷2.

Figure 16B:
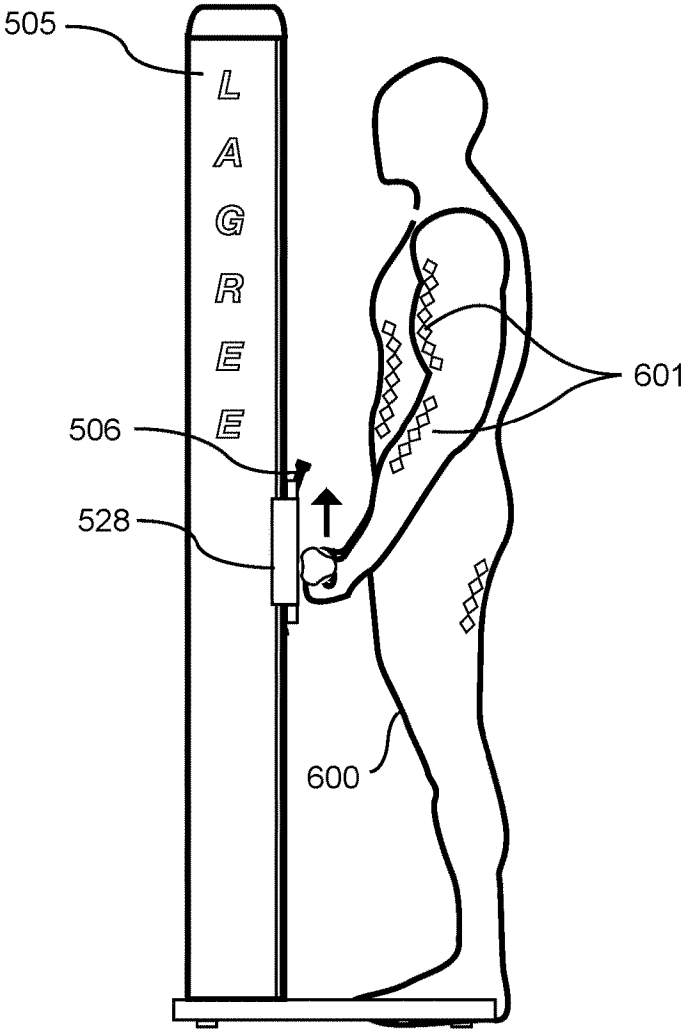
FIG. 16B is an exemplary diagram showing a side view of an improved arm exercise machine.
Figure 16A:
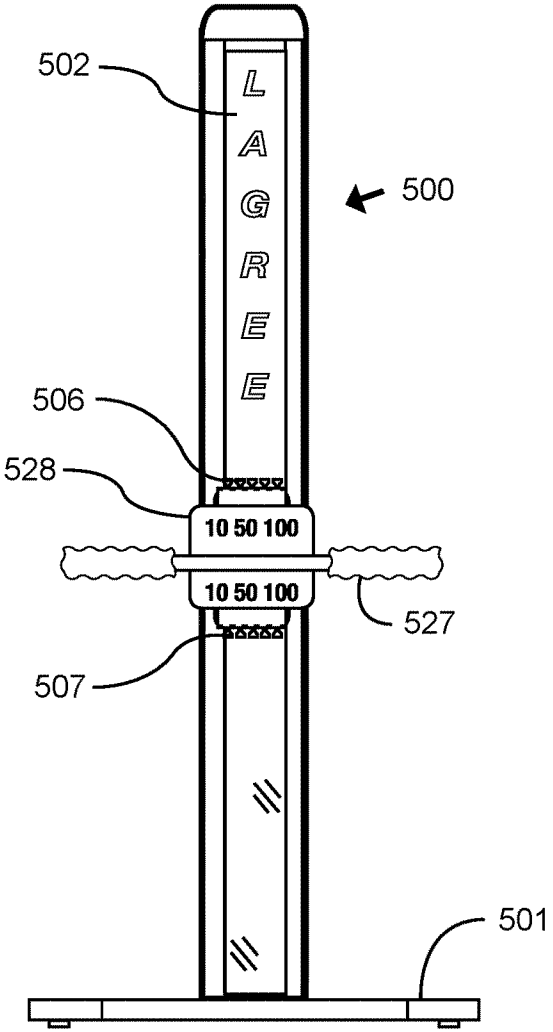
FIG. 16A is an exemplary diagram showing a front view of an improved arm exercise machine.

FIG. 16A is an exemplary diagram showing a front view of an improved arm exercise machine. One variation of a vertical exercise machine 500 is shown with a support base 501 and a substantially vertical structure with a front enclosure 502. A vertical trolley 528 is substantially the horizontally positioned trolley previously discussed, but configured in a vertical orientation. The trolley provides for a substantially fixed handle 527 used to pull the trolley in an upward direction, or alternatively to push the trolley in a downward direction, preferably with sufficient force so as to exceed the resistance of the attached extension springs not shown.

The trolley further provides for upper tension knobs 506 which are removably attached to the upper portion of the trolley for exercises that require an exerciser to lift the fixed handle 527 against a biasing member not shown, and for lower tension knobs 507 removably attached to the lower portion of the trolley for exercises that require an exerciser to push down on the fixed handle.

FIG. 16B is an exemplary diagram showing a side view of an improved arm exercise machine with the biasing members 218 not shown, but positioned within the structure behind a side enclosure 505. An exerciser 600 is shown positioned in front of an improved vertical exercise machine with the hands grasping the fixed handle 527. One or more upper tension knobs 506, having been removably attached to the vertical trolley 538 are connected to one or more biasing members 218 not shown, but which have been previously discussed.

The instant exercise requires the exerciser 600 to raise the fixed handle, thereby lifting the trolley 528 upwardly against the resistance of the removably attached biasing members 218. This exercise is well known to those skilled in the art, and is frequently referred to as a biceps curl which activates the primary muscles 601 generally shown by the cross-hatched areas on the exerciser's body.

Figure 16D:
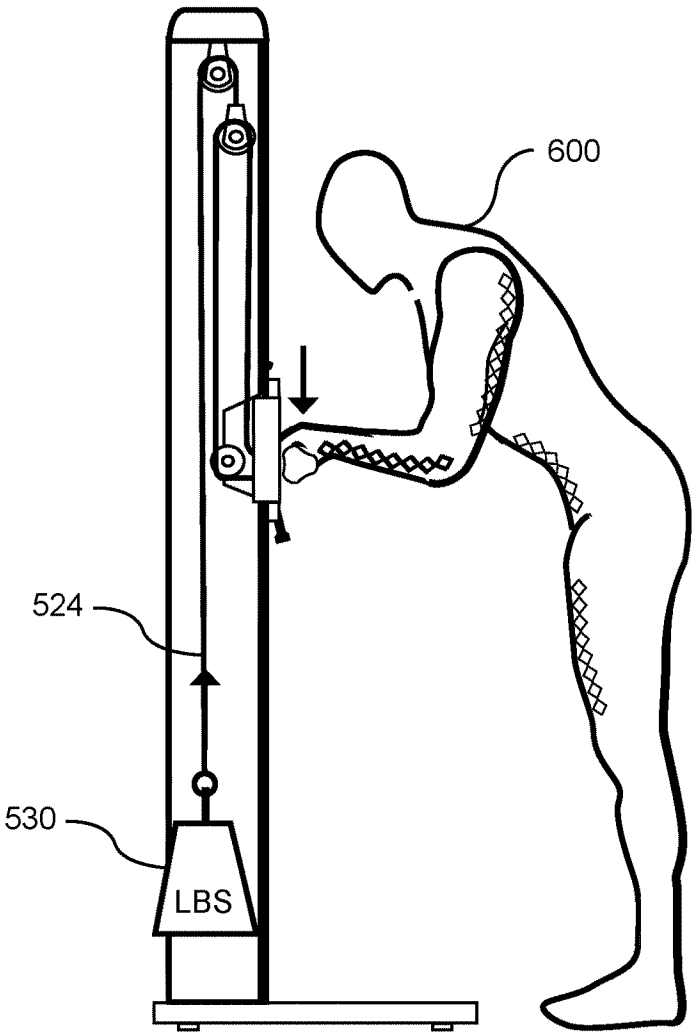
FIG. 16D is an exemplary diagram showing a side view of an improved exercise machine using dead weights.
Figure 16C:
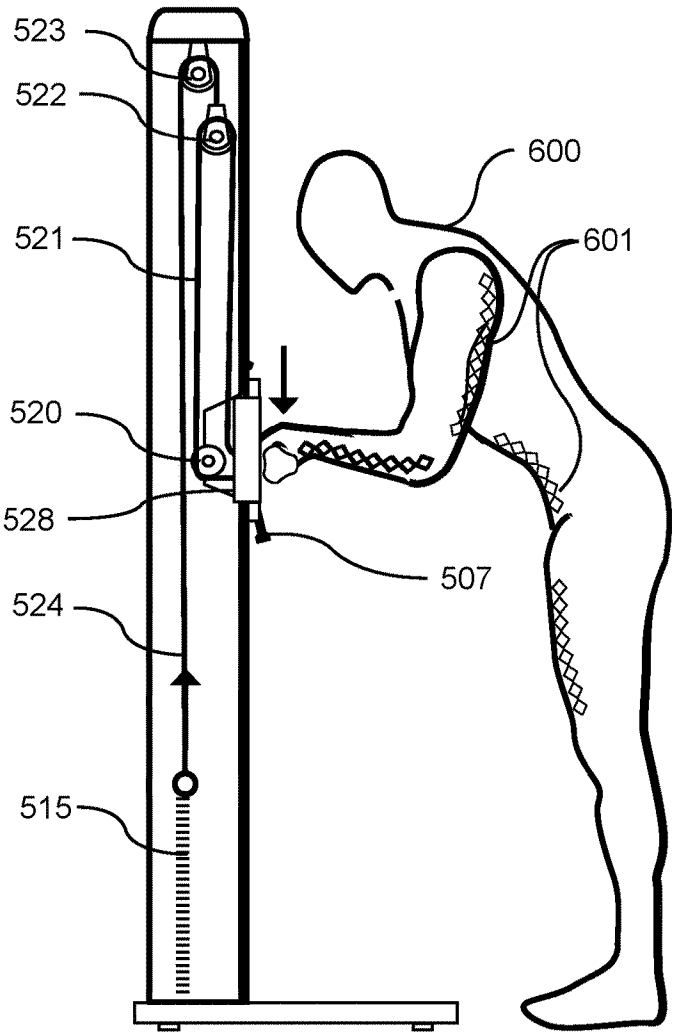
FIG. 16C is an exemplary diagram showing a side view of an improved arm exercise machine with a side cover removed.

FIG. 16C is an exemplary diagram showing a side view of an improved arm exercise machine with a side cover removed. A resistance force may be applied to the vertical trolley, and correspondingly to the fixed handle, by means of one or more of a plurality of biasing members 218, each biasing member being comprised of a looped cable 521 with each end terminated with an upper tension knob and lower tension knob. The looped cable wraps around two outer pulleys not shown, and an inner pulley 520 of a pulley as shown. Each looped cable further wraps around one return pulley 522 which, by means of a shackle is connected to a tension cable 524 after wrapping around an idler pulley 523 affixed to substantially the upper structure of the vertical exercise machine.

Each tension cable is affixed to a movable end of one or more extension springs 515. The instant exercise requires the exerciser to depress the fixed handle, thereby lowering the trolley 528 against the resistance of the removably attached biasing members 218. This exercise is well known to those skilled in the art, and is frequently referred to as a triceps press which activates the primary muscles 601 generally shown by the crosshatched areas on the exerciser's body.

FIG. 16D is an exemplary diagram showing a side view of an improved arm exercise machine with a traditional dead weight. The novel vertical exercise machine is not limited to use of biasing members 218 comprising extension springs. Those skilled in the art will recognize exercise machines that use dead weight as the resistance means, the dead weight often comprising one or more steel plates of known weight.

In the drawing, the previously discussed one or more extension springs have been replaced with a dead weight 530, the dead weight being of any size or configuration well known in the exercise equipment field. It should be known that the extension spring or weight stack may be used to provide substantially the same functionality previously described, namely that each biasing member, whether comprising a spring or dead weight, may be interchangeably used to provide resistance for exercises that require a lifting force or downward force by means or removably attaching the upper tension knobs, or the lower tension knobs to the retaining bracket on the vertical trolley.

Figure 17B:
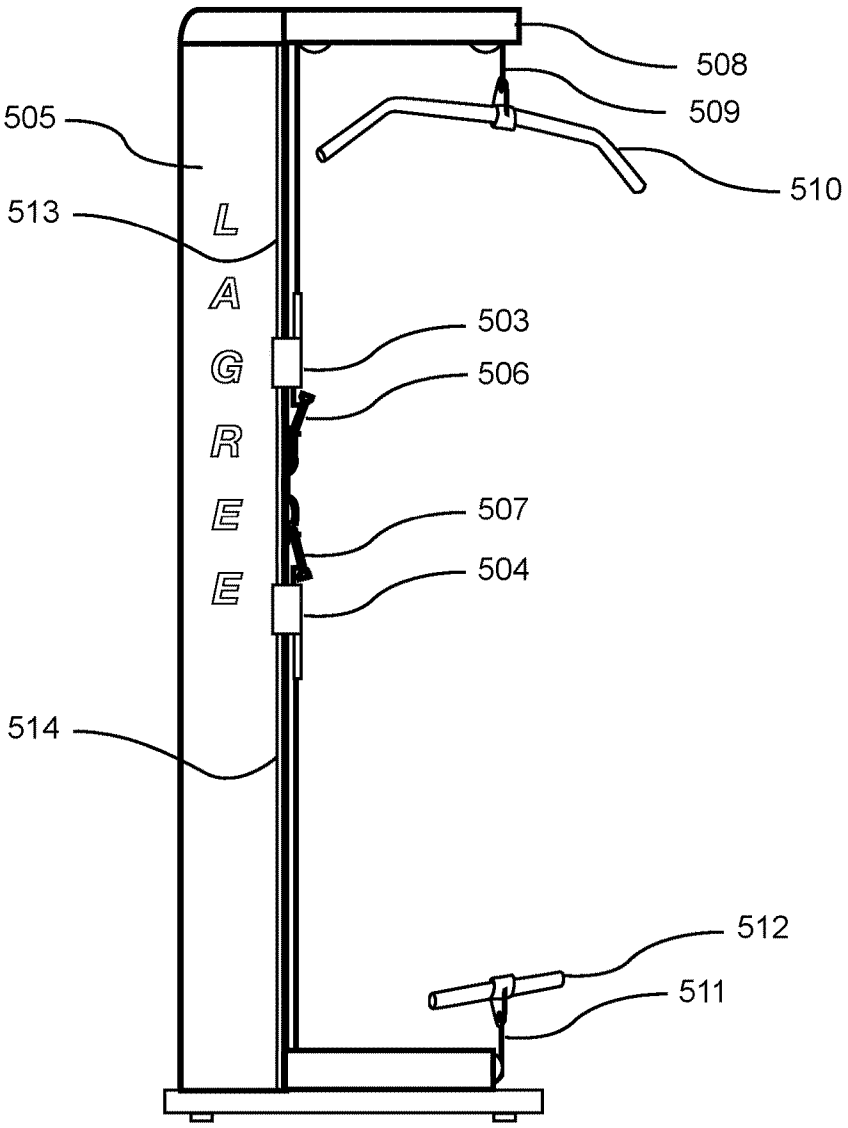
FIG. 17B is an exemplary diagram showing a side view of an improved exercise machine with a vertical longitudinal axis.
Figure 17A:
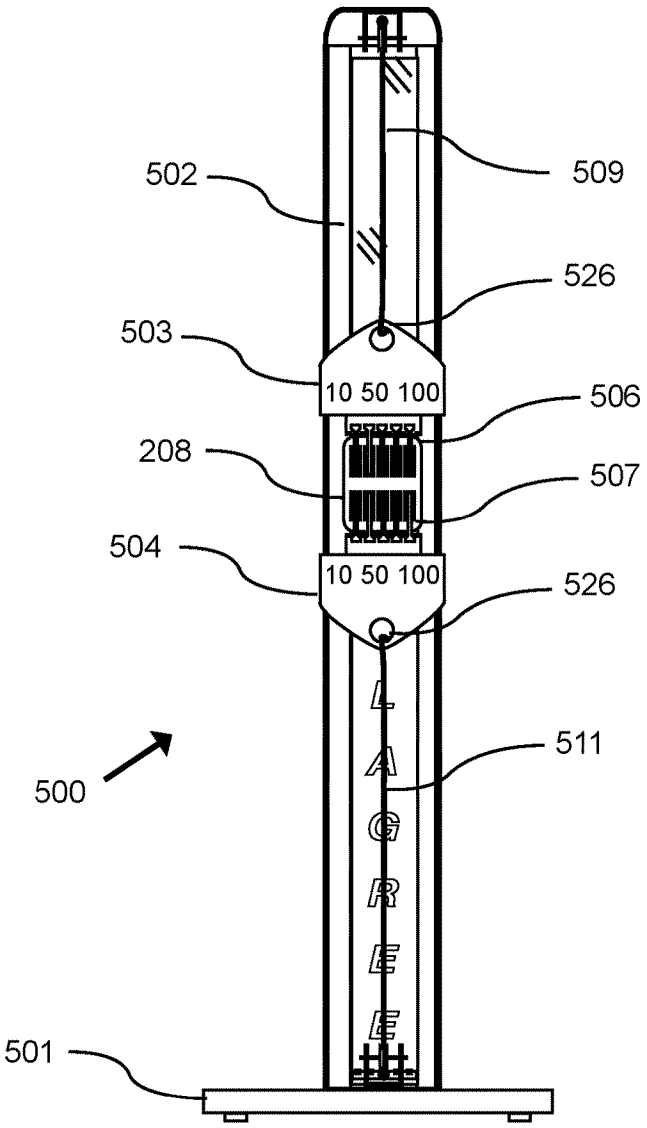
FIG. 17A is an exemplary diagram showing the front view of an improved exercise machine with a vertical longitudinal axis.

FIG. 17A is an exemplary diagram showing the front view of another variation of an improved exercise machine with a vertical longitudinal axis, comprising two vertical trolleys. It should be first noted that a single movable carriage as previous described may be used in the vertical orientation of the instant drawings with the same method of operation as previously described, that being that the front tension knobs 203 (equivalent to upper tension knobs when oriented vertically) and back tension knobs 204 (equivalent to lower tension knobs when oriented vertically) may be removably attached to the proximate retaining brackets on the opposed ends of the movable carriage. When oriented vertically, the movable carriage may be redefined as a movable trolley.

However, the instant drawing illustrates a variation of the single movable carriage, providing for two movable trolleys, an upper trolley 503 to which upper knobs 506 may be removably attached, and a lower trolley 504 to which lower tension knobs 507 may be removably attached.

One significant advantage of a two-trolley configuration as shown in the drawing is that separate and different tensions may be preset for the pull-down direction of the lower trolley 504 and the pull-up direction of the upper trolley 503 without having to clear all tension knobs from a first end of the movable trolley before engaging tension knobs on a second end of the movable trolley. This benefit provides for an exerciser to move quickly from a pull-down exercise to a pull-up exercise without having to re-set any tension knobs.

In the drawing, a substantially vertical exercise machine 500 is shown with a support base 501, a front enclosure 502, an upper trolley 503 and lower trolley 504 vertically movable upon a pair or parallel rails not shown. A pull-down cable 509 is affixed to the upper trolley 503 by means of a cable-trolley clasp 526, and a pull-up cable 511 is affixed to the lower trolley 504 by means of a cable-trolley clasp 526. A pulley cassette 208 is affixed to the structure of the vertical exercise machine and retains upper tension knobs 506 and lower tension knobs 507 in respective retainer brackets that are too small to be clearly shown in the present illustration.

FIG. 17B is an exemplary diagram showing a side view of an improved exercise machine with a vertical longitudinal axis. A pull down boom 508 is shown extending from and substantially at the upper end of the vertical machine, the boom providing for extending the pull down cable 509 and pull down handles 510 a preferred distance from the vertical structure for ease of exercising. A pull up cable 511 and pull up handle 512 are shown at a preferred distance from the vertical structure for ease of exercising, however the extension of the pull down cable and pull up cable may be the same distance or a different distance from the vertical structure.

A side enclosure 505 is shown on the proximate side, but a mirror image side enclosure is provided on the distal side of the structure, thereby enclosing the vertical structure for safety and cosmetics. One of a pair of parallel upper vertical trolley rails 513 provide for the upper trolley 503 to move within a preferred vertical path and distance, and one of a pair of parallel lower vertical trolley rails 514 provide for the lower trolley 504 to move within a preferred vertical path and distance. During exercise, one or more upper tension knobs 506 may be removably attached to the upper retainer bracket of the upper trolley 503, and one or more lower tension knobs 507 may be removably attached to the lower retainer bracket of the lower trolley 504 as desired for exercising.

Figure 18:
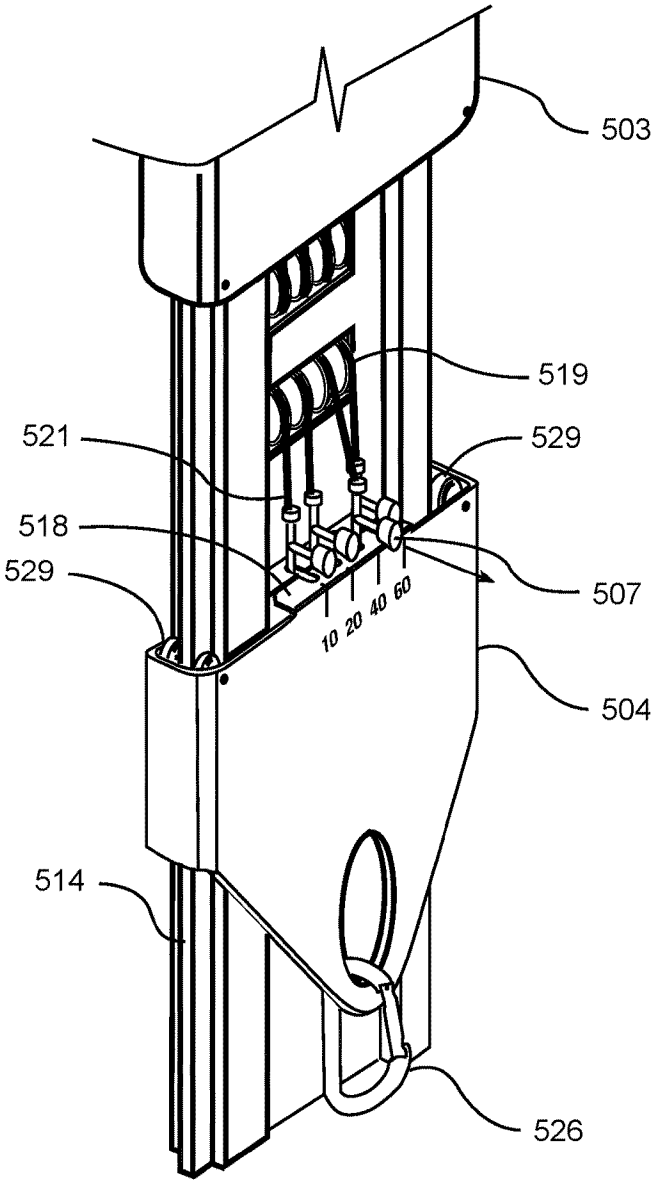
FIG. 18 is an exemplary diagram showing a perspective view of a resistance selection portion of an improved vertically oriented exercise machine.

FIG. 18 is an exemplary diagram showing a perspective view of a resistance selection portion of an improved vertically oriented exercise machine. It should be noted that the perspective, while illuminating the operable features of the lower trolley 504, obscures the operable features of the upper trolley 503, however the operable features of the upper trolley are substantially mirror images of the described features of the lower trolley. A lower trolley 504 is movable vertically substantially along parallel lower trolley rails 514, rollable by means of trolley wheels 529 affixed to the trolley. One end of a looped cable 521 is affixed to a corresponding lower tension knob, wrapping about a portion of an outer pulley 519, with the distal end of the looped cable affixed to a corresponding upper tension knob not shown. As a means of applying a resistance force to the lower trolley, one or more of the lower tension knobs 507 are repositioned from their unused storage position upon the vertical structure, to the lower trolley retainer bracket 518, thereby transferring the resistance potential of the biasing member to the lower trolley for exercising.

Figure 19B:
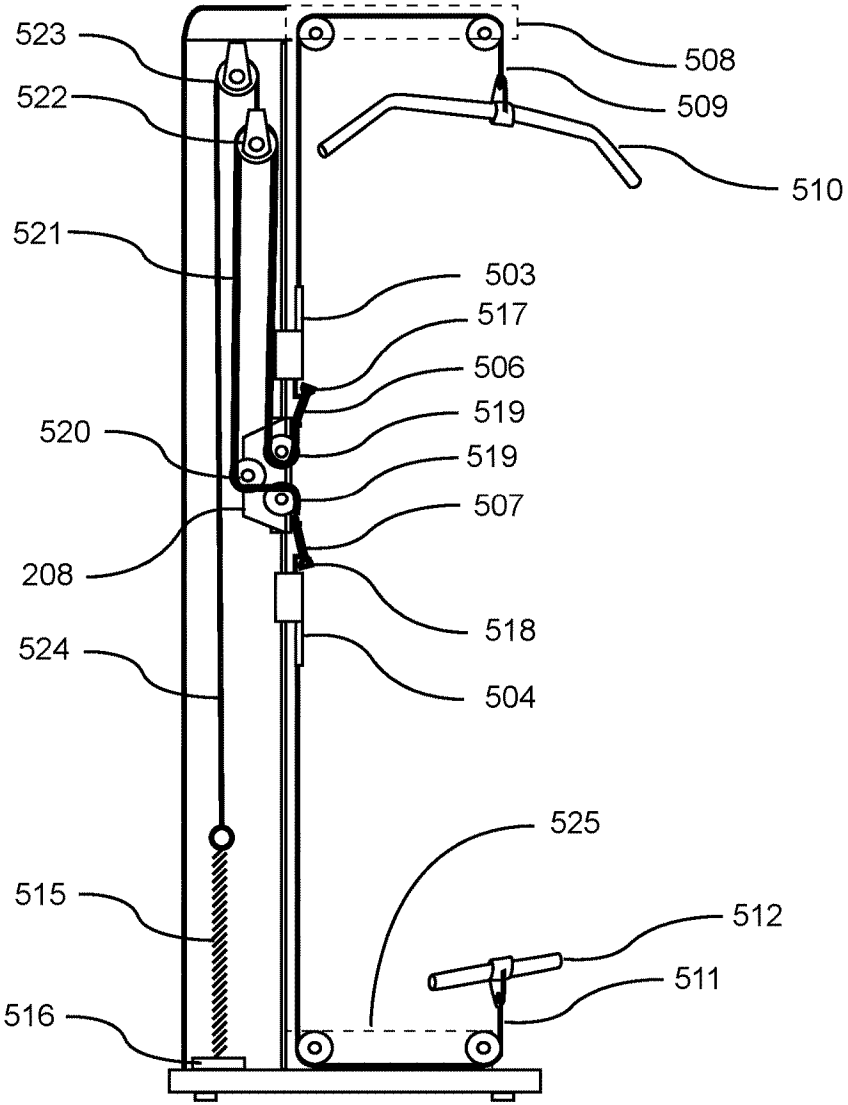
FIG. 19B is an exemplary diagram showing a side view of an improved exercise machine with a vertical longitudinal axis, and with side panel covers removed.
Figure 19A:
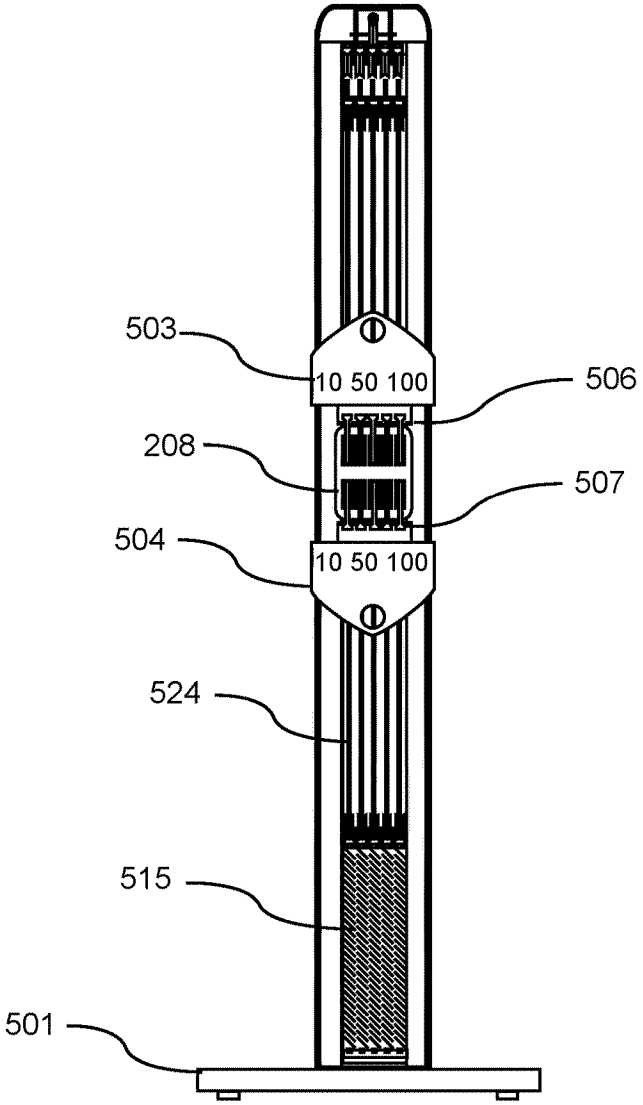
FIG. 19A is an exemplary diagram showing the front view of an improved exercise machine with a vertical longitudinal axis, and with front panel covers removed.

FIG. 19A is an exemplary diagram showing the front view of an improved exercise machine with a vertical longitudinal axis, and with front panel covers removed. In the drawing, an exercise machine structure extends vertically from a support base 501. A plurality of extension springs 515 are secured at the lower ends to a spring mounting member, and secured to tension cables 524 at the upper ends. An upper trolley 503 and proximate upper tension knobs 506 are shown proximate to the upper end of the pulley cassette 208, and a lower trolley 504 and proximate lower tension knobs 507 are shown proximate to the lower end of the pulley cassette 208. Numerals on the face of the upper and lower trolleys may be used as indicators of the weight in pounds that would be equivalent to the resistance of each biasing member when the knobs corresponding to any numeral are removably attached to either tension knob retainer bracket of the upper or lower pulley.

FIG. 19B is an exemplary diagram showing a side view of an improved exercise machine with a vertical longitudinal axis, and with side panel covers removed. A pull down cable 509 removably attached to a pull down handle 510 extends upward, wrapping over a portion of a first pulley retained within a pull down boom 508, further wrapping around a second pulley retained within the boom, and extending downward with the distal end of the cable connected to an upper trolley 503 by means of a cable-trolley clasp. A tension knob retaining bracket 517 is provided on the substantially lower end of the upper trolley wherein one or more of the upper tension knobs can be removably attached.

Further, a pull up cable 511 removably attached to a pull up handle 512 extends downward, wrapping over a portion of a first pulley retained within a pull up boom 525, further wrapping around a second pulley retained within the pull up boom, and extending upward with the distal end of the cable connected to an lower trolley 504 by means of a cable-trolley clasp. A tension knob retaining bracket 518 is provided on the substantially upper end of the lower trolley wherein one or more of the upper tension knobs can be removably attached.

A resistance force may be applied to one or more of the upper and lower trolleys by means of one or more of a plurality of biasing members 218, each biasing member being comprised of a looped cable 521 with each end terminated with an upper tension knob and lower tension knob. The looped cable wraps around two outer pulleys 519 and an inner pulley 520 of a pulley cassette 208 as shown. Each looped cable further wraps around one return pulley 522 which, by means of a shackle is connected to a tension cable 524 after wrapping around an idler pulley 523 affixed to substantially the upper structure of the vertical exercise machine. Each tension cable is affixed to a movable end of one or more extension springs 515, the opposed end of each of the extension springs affixed to a spring mounting member 516.

Figure 20:
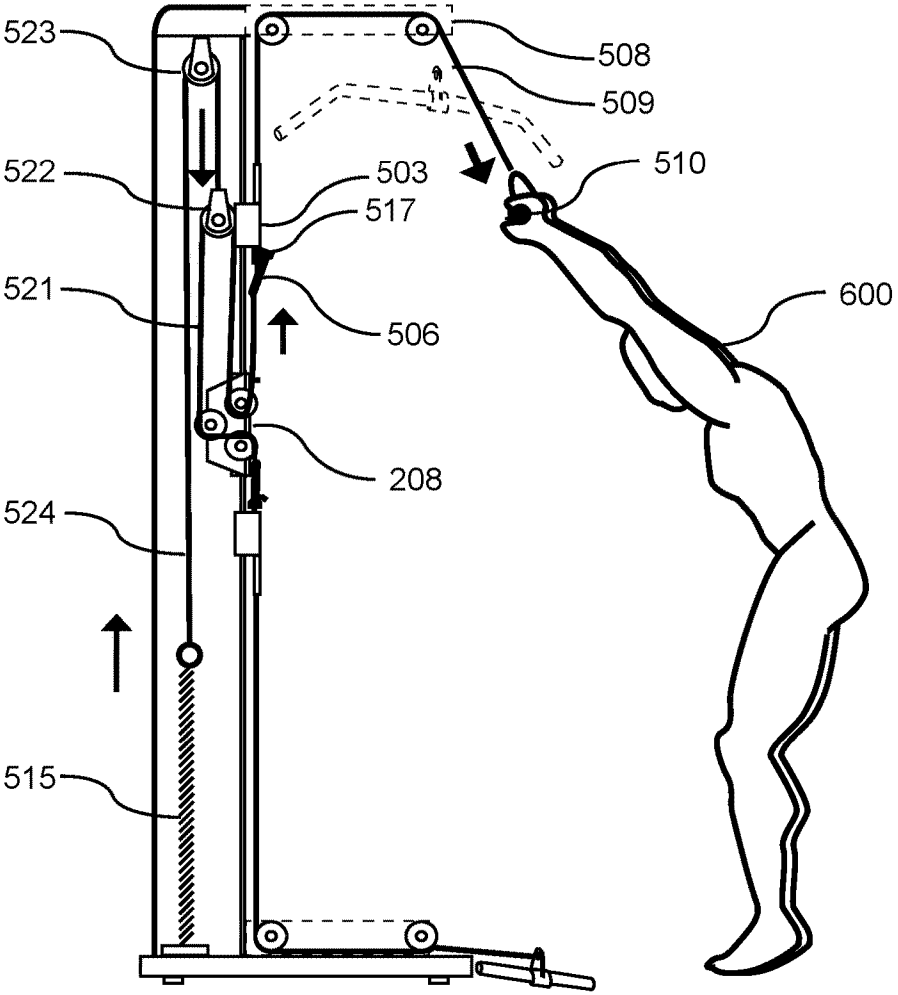
FIG. 20 is an exemplary diagram showing a side view of an improved exercise machine with an exerciser performing a pull-down exercise.

FIG. 20 is an exemplary diagram showing a side view of an improved exercise machine with an exerciser 600 performing a pull-down exercise. In practice, an exerciser first removably attaches one or more upper tension knobs 517 to the tension knob retainer bracket on the lower side of the upper trolley 503, thereby establishing the desired resistance tension for the exercise. The exerciser then grasps the pull down handle 510 which is connected to the pull down cable 509, and by pulling the handle downward, pulls the pull down cable through pulleys within the pull down boom 508, the cable thereby pulling the upper trolley 503 upward. Correspondingly, the upper tension knob attached to the upper trolley pulls a looped cable through the pulley cassette 208 as previously discussed. The lower tension knob being statically retained in a lower retainer bracket prevents the opposed end of the looped cable from pulling through the pulley cassette. The action just described provides for the return pulley 522 to be pulled in a downward direction which causes the proximate end of the tension cable 524 to be pulled through the idler pulley 523 and against the resistance of at least one preferred extension spring 515.

Figure 21:
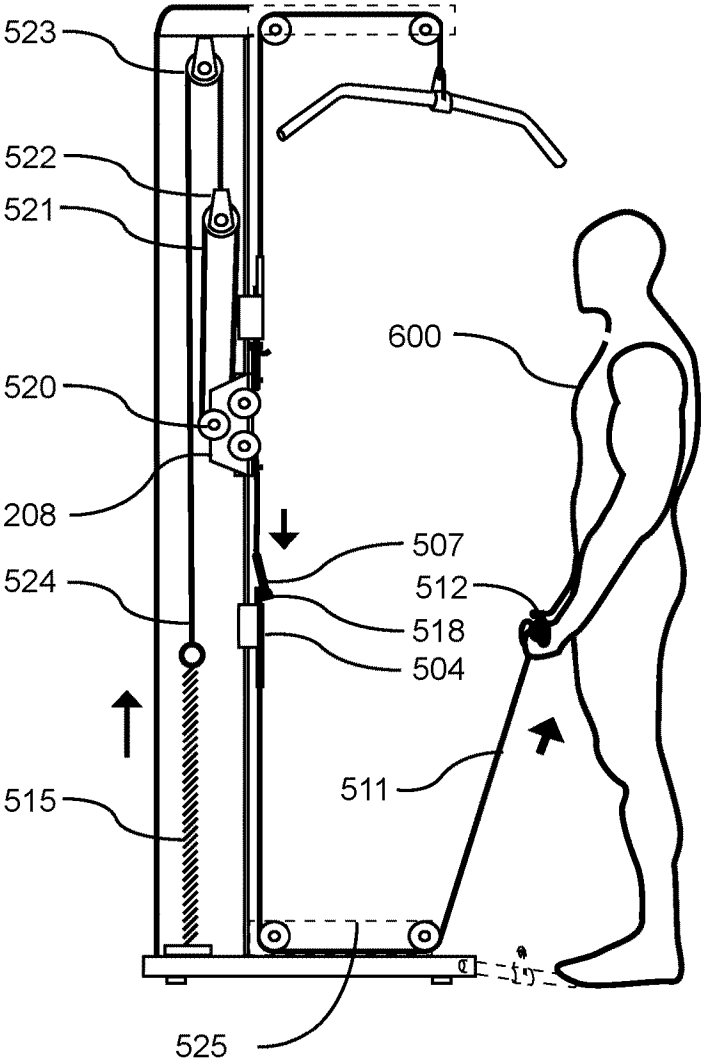
FIG. 21 is an exemplary diagram showing a side view of an improved exercise machine with an exerciser performing a pull-up exercise.

FIG. 21 is an exemplary diagram showing a side view of an improved exercise machine with an exerciser 600 performing a pull-up exercise. In practice, an exerciser first removably attaches one or more lower tension knobs 518 to the tension knob retainer bracket on the upper side of the lower trolley 504, thereby establishing the desired resistance tension for the exercise. The exerciser then grasps the pull up handle 512 which is connected to the pull up cable 511, and by pulling the handle upward, pulls the pull up cable through pulleys within the pull up boom 525, the cable thereby pulling the lower trolley 504 downward. Correspondingly, the lower tension knob attached to the lower trolley pulls a looped cable through the pulley cassette 208 as previously discussed. The upper tension knob being statically retained in an upper retainer bracket prevents the opposed end of the looped cable from pulling through the pulley cassette. The action just described provides for the return pulley 522 to be pulled in a downward direction which causes the proximate end of the tension cable 524 to be pulled through the idler pulley 523 and against the resistance of at least one preferred extension spring 515.

As shown in FIGS. 1 through 4 of the drawings, the exercise machine includes a frame having a first end, a second end opposite of the first end, and a longitudinal axis extending therebetween. The exercise machine preferably includes a carriage 202 movably positioned upon the frame as further shown in FIGS. 1-4. The carriage 202 includes a first end and a second end opposite the first end wherein the first end and second end of the carriage 202 are spaced apart along the longitudinal axis. The carriage 202 is adapted to be movable in opposed first and second directions along a portion of the longitudinal axis. A first end platform is preferably attached to the frame near the first end of the frame and a second end platform is preferably attached to the frame near the second end of the frame.

A plurality of biasing members 218 are provided to selectively provide an adjustable amount of resistance force for resisting movement of the carriage 202 in either the first direction or the second direction. A user selectable amount of force may be applied to the carriage 202 to resist movement in either of the first direction and the second direction.

A plurality of first tension connectors 203 are accessible near the first end of the carriage 202 and are adapted for removably attaching selected biasing members 218 at or near the first end of the carriage 202 to resist motion of the carriage 202 in the first direction. A plurality of second tension connectors 204 are accessible near the second end of the carriage 202 and are adapted for removably attaching selected biasing members 218 at or near the second end of the carriage 202 to resist motion of the carriage 202 in the second direction.

In an embodiment, at least one biasing member has a first end and a second end wherein the first end is attached to the frame and the second end comprises one of the plurality of first tension connectors 203. In an embodiment, at least one biasing member has a first end and a second end wherein the first end is attached to the frame and the second end comprises one of the plurality of second tension connectors 204. In another embodiment shown in FIGS. 12 and 13, the at least one biasing member has a first end and a second end wherein the first end is attached to the frame and the second end comprises a first tension connector 203 and a second tension connector 204. As further shown in the embodiment illustrated in FIGS. 12 and 13, the second end of the at least one biasing member comprises a cable having a first end and a second end, wherein the first end of the cable comprises the first tension connector 203 and the second end of the cable comprises the second tension connector 204.

As further shown in FIGS. 12 and 13, various embodiments include a first retention member 213 positioned on the carriage 202 near the first end of the carriage 202 wherein the first retention member 213 is adapted to catchably receive the plurality of first tension connectors 203. A second retention member 232 is positioned on the carriage 202 near the second end of the carriage 202, wherein the second retention member 232 is adapted to catchably receive the plurality of second tension connectors 204. The first retention member 213 and the second retention member 232 are each preferably comprised of a bracket but may be comprised of other structures.

As illustrated in FIGS. 9 and 10, a third retention member and a fourth retention member are connected to the frame, wherein the third retention member is adapted to catchably receive the plurality of first tension connectors 203 and wherein the fourth retention member is adapted to catchably receive the plurality of second tension connectors 204. When the plurality of first tension connectors 203 are connected to the first retention member 213 the plurality of biasing members 218 corresponding to the plurality of first tension connectors 203 resist motion of the carriage 202 in the first direction. When the plurality of second tension connectors 204 are connected to the second retention member 232 the plurality of biasing members 218 corresponding to the plurality of second tension connectors 204 resist motion of the carriage 202 in the second direction.

The first retention member 213 and the second retention member 232 preferably extend downwardly from the carriage 202 as illustrated in FIGS. 12 and 13. In the embodiment shown in FIG. 11, the first retention member 213 and the second retention member 232 preferably each include a plurality of receiver slots adapted to removably receive the plurality of first tension connectors 203 and the plurality of second tension connectors 204 correspondingly. The first tension connectors 203 and the second tension connectors 204 are each preferably comprised of a knob but may be comprised of other structures.

In use, the exerciser attaches a first tension connector 203 at or near the first end of the carriage 202. The exerciser then mounts the carriage 202 if not already on the carriage 202. The exerciser then moves the carriage 202 alternately in the first direction against the force resisting motion of the platform and the second direction while performing an exercise. The exerciser then detaches the first tension connector 203 from the carriage 202 and attaches a second tension connector 204 at or near the second end of the carriage 202 thereafter moving the carriage 202 alternately in the second direction against the force resisting motion of the platform and the first direction while performing an exercise. Various numbers of biasing members 218 may be connected to the first end or the second end of the carriage 202 to provide various levels of resistance force in either the first direction or the second direction of movement of the carriage 202.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the reversible resistance exercise machine, suitable methods and materials are described above. All publications, patent applications, patents, and other references mentioned herein are incorporated by reference in their entirety to the extent allowed by applicable law and regulations. The reversible resistance exercise machine may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having at least one rail;

a first end platform attached to the frame near a first end of the frame and a second end platform attached to the frame near a second end of the frame;

a carriage movably positioned upon the at least one rail of the frame, wherein the carriage includes a first end and a second end opposite the first end of the carriage, wherein the first end and second end of the carriage are spaced apart, wherein the carriage is adapted to be movable in a first direction and a second direction, and wherein the first direction is opposite of the second direction;

a plurality of springs each operative to provide a force for resisting movement of the carriage, wherein each of the plurality of springs has a first end and a second end;

a plurality of first tension connectors accessible near the first end of the carriage and adapted for removably attaching selected springs at or near the first end of the carriage to resist motion of the carriage in the first direction;

a plurality of second tension connectors accessible near the second end of the carriage and adapted for removably attaching selected springs at or near the second end of the carriage to resist motion of the carriage in the second direction;

a plurality of return pulleys, wherein each second end of the plurality of springs is connected to a respective return pulley of the plurality of return pulleys; and a plurality of elongated flexible members each having a first end and a second end, wherein the first end of each of the plurality of elongated flexible members is coupled to a respective first tension connector of the plurality of first tension connectors, wherein the second end of each of the plurality of elongated flexible members is coupled to a respective second tension connector of the plurality of second tension connectors, and wherein each of the plurality of elongated flexible members pass through a respective return pulley of the plurality of return pulleys.

2. The exercise machine of claim 1, comprising:

a first retention member positioned on the carriage near the first end of the carriage, wherein the first retention member is adapted to catchably receive the plurality of first tension connectors; and a second retention member positioned on the carriage near the second end of the carriage, wherein the second retention member is adapted to catchably receive the plurality of second tension connectors.

3. The exercise machine of claim 2, wherein the first retention member and the second retention member are each comprised of a bracket.

4. The exercise machine of claim 2, wherein when the plurality of first tension connectors are connected to the first retention member, the plurality of springs corresponding to the plurality of first tension connectors resist motion of the carriage in the first direction, and wherein when the plurality of second tension connectors are connected to the second retention member, the plurality of springs corresponding to the plurality of second tension connectors resist motion of the carriage in the second direction.

5. The exercise machine of claim 2, wherein the first retention member and the second retention member extend downwardly from the carriage.

6. The exercise machine of claim 2, wherein the first retention member and the second retention member each include a plurality of receiver slots adapted to removably receive the plurality of first tension connectors and the plurality of second tension connectors correspondingly.

7. The exercise machine of claim 1, wherein the plurality of first tension connectors and the plurality of second tension connectors are each comprised of a knob.

8. The exercise machine of claim 1, wherein each of the plurality of elongated flexible members are comprised of a cable.

9. The exercise machine of claim 1, wherein each of the plurality of elongated flexible members are comprised of a metal cable.

10. The exercise machine of claim 1, including a plurality of upper pulleys connected to the carriage and a plurality of lower pulleys connected to the carriage, wherein each of the plurality of elongated flexible members pass through at least two of the plurality of upper pulleys and at least one of the plurality of lower pulleys.

11. A method of using the exercise machine of claim 1, comprising:

attaching a first tension connector at or near the first end of the carriage;

moving the carriage alternately in the first direction against the force for resisting motion of the carriage and the second direction while performing an exercise;

detaching the first tension connector from the carriage;

attaching a second tension connector at or near the second end of the carriage; and moving the carriage alternately in the second direction against the force for resisting motion of the carriage and the first direction while performing an exercise.

12. An exercise machine, comprising:

a frame having at least one rail;

a first end platform attached to the frame near a first end of the frame and a second end platform attached to the frame near a second end of the frame;

a carriage movably positioned upon the at least one rail of the frame, wherein the carriage includes a first end and a second end opposite the first end of the carriage, wherein the first end and second end of the carriage are spaced apart, wherein the carriage is adapted to be movable in a first direction and a second direction, and wherein the first direction is opposite of the second direction;

a plurality of springs each operative to provide a force for resisting movement of the carriage, wherein each of the plurality of springs has a first end and a second end;

a plurality of first tension connectors accessible near the first end of the carriage and adapted for removably attaching selected springs at or near the first end of the carriage to resist motion of the carriage in the first direction;

a plurality of second tension connectors accessible near the second end of the carriage and adapted for removably attaching selected springs at or near the second end of the carriage to resist motion of the carriage in the second direction;

wherein the plurality of first tension connectors and the plurality of second tension connectors are each comprised of a knob;

a plurality of return pulleys, wherein each second end of the plurality of springs is connected to a respective return pulley of the plurality of return pulleys;

a plurality of elongated flexible members each having a first end and a second end, wherein the first end of each of the plurality of elongated flexible members is coupled to a respective first tension connector of the plurality of first tension connectors, wherein the second end of each of the plurality of elongated flexible members is coupled to a respective second tension connector of the plurality of second tension connectors, and wherein each of the plurality of elongated flexible members pass through a respective return pulley of the plurality of return pulleys;

a first retention member positioned on the carriage near the first end of the carriage, wherein the first retention member is adapted to catchably receive the plurality of first tension connectors; and a second retention member positioned on the carriage near the second end of the carriage, wherein the second retention member is adapted to catchably receive the plurality of second tension connectors.

13. The exercise machine of claim 12, wherein the first retention member and the second retention member are each comprised of a bracket.

14. The exercise machine of claim 12, wherein when the plurality of first tension connectors are connected to the first retention member, the plurality of springs corresponding to the plurality of first tension connectors resist motion of the carriage in the first direction, and wherein when the plurality of second tension connectors are connected to the second retention member, the plurality of springs corresponding to the plurality of second tension connectors resist motion of the carriage in the second direction.

15. The exercise machine of claim 12, wherein the first retention member and the second retention member extend downwardly from the carriage.

16. The exercise machine of claim 12, wherein the first retention member and the second retention member each include a plurality of receiver slots adapted to removably receive the plurality of first tension connectors and the plurality of second tension connectors correspondingly.

17. The exercise machine of claim 12, wherein each of the plurality of elongated flexible members are comprised of a cable.

18. The exercise machine of claim 12, including a plurality of upper pulleys connected to the carriage and a plurality of lower pulleys connected to the carriage, wherein each of the plurality of elongated flexible members pass through at least two of the plurality of upper pulleys and at least one of the plurality of lower pulleys.

19. A method of using the exercise machine of claim 12, comprising:

attaching a first tension connector at or near the first end of the carriage;

moving the carriage alternately in the first direction against the force for resisting motion of the carriage and the second direction while performing an exercise;

detaching the first tension connector from the carriage;

attaching a second tension connector at or near the second end of the carriage; and moving the carriage alternately in the second direction against the force for resisting motion of the carriage and the first direction while performing an exercise.

20. An exercise machine, comprising:

a frame having at least one rail;

a first end platform attached to the frame near a first end of the frame and a second end platform attached to the frame near a second end of the frame;

a carriage movably positioned upon the at least one rail of the frame, wherein the carriage includes a first end and a second end opposite the first end of the carriage, wherein the first end and second end of the carriage are spaced apart, wherein the carriage is adapted to be movable in a first direction and a second direction, and wherein the first direction is opposite of the second direction;

a plurality of springs each operative to provide a force for resisting movement of the carriage, wherein each of the plurality of springs has a first end and a second end;

a plurality of first tension connectors accessible near the first end of the carriage and adapted for removably attaching selected springs at or near the first end of the carriage to resist motion of the carriage in the first direction;

a plurality of second tension connectors accessible near the second end of the carriage and adapted for removably attaching selected springs at or near the second end of the carriage to resist motion of the carriage in the second direction;

a plurality of return pulleys, wherein each second end of the plurality of springs is connected to a respective return pulley of the plurality of return pulleys;

a plurality of elongated flexible members each having a first end and a second end, wherein the first end of each of the plurality of elongated flexible members is coupled to a respective first tension connector of the plurality of first tension connectors, wherein the second end of each of the plurality of elongated flexible members is coupled to a respective second tension connector of the plurality of second tension connectors, and wherein each of the plurality of elongated flexible members pass through a respective return pulley of the plurality of return pulleys;

a first retention member positioned on the carriage near the first end of the carriage, wherein the first retention member is adapted to catchably receive the plurality of first tension connectors, and wherein when the plurality of first tension connectors are connected to the first retention member, the plurality of springs corresponding to the plurality of first tension connectors resist motion of the carriage in the first direction; and a second retention member positioned on the carriage near the second end of the carriage, wherein the second retention member is adapted to catchably receive the plurality of second tension connectors, and wherein when the plurality of second tension connectors are connected to the second retention member, the plurality of springs corresponding to the plurality of second tension connectors resist motion of the carriage in the second direction;

wherein the first retention member and the second retention member each include a plurality of receiver slots adapted to removably receive the plurality of first tension connectors and the plurality of second tension connectors correspondingly.

* * * * *